US008150280B2

(12) United States Patent
Omata

(10) Patent No.: US 8,150,280 B2
(45) Date of Patent: Apr. 3, 2012

(54) IMAGE FORMING SYSTEM

(75) Inventor: Haruhiko Omata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 778 days.

(21) Appl. No.: 12/181,760

(22) Filed: Jul. 29, 2008

(65) Prior Publication Data

US 2009/0034998 A1 Feb. 5, 2009

(30) Foreign Application Priority Data

Aug. 3, 2007 (JP) ..... 2007-202745

(51) Int. Cl.
*G03G 15/00* (2006.01)
*G03G 15/08* (2006.01)

(52) U.S. Cl. ..... 399/45; 399/53

(58) Field of Classification Search ..... 399/39, 399/45, 53, 54, 82
See application file for complete search history.

(56) References Cited

U.S. PATENT DOCUMENTS

| | | | | |
|---|---|---|---|---|
| 7,046,364 | B2 * | 5/2006 | Schneider et al. | 356/446 |
| 2006/0044617 | A1 * | 3/2006 | Wang et al. | 358/3.06 |
| 2006/0275058 | A1 | 12/2006 | Omata | |
| 2006/0285890 | A1 * | 12/2006 | Ng | 399/329 |

FOREIGN PATENT DOCUMENTS

JP 2002-207334 A 7/2002

OTHER PUBLICATIONS

W.A. Lee et al., The Glass Transition Temperatures of Polymers, *Polymer Handbook*, Second Edition, Brandup et al., Editors, John Wiley & Sons, New York, pp. III-39 through III-192 (1975).

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

An image forming system includes an image forming station for forming a transparent image on a recording material with transparent toner; a selecting portion for selecting one of image forming modes including a first image forming mode for forming a transparent image having a high glossiness and a second image forming mode for forming a transparent image having a glossiness lower than that in the first image forming mode; and a setting portion for setting a toner amount, per unit area, of the transparent image in accordance with the image forming mode selected by the selecting portion.

6 Claims, 12 Drawing Sheets

IMAGE FORMING SYSTEM

FIELD OF THE INVENTION AND RELATED ART

The present invention relates to an image formation system which forms an image with the use of transparent toner (clear toner).

In recent years, in the field of electrophotographic technology, transparent toner has been used to raise the glossiness level at which an image forming apparatus forms an image. More specifically, an image formed of transparent toner is layered on top of the yellow, magenta, cyan, and black toner images formed in layers on a sheet of recording medium, in order to make the layered combination of the yellow, magenta, cyan, black, and transparent toner images, uniform in height thickness so that the combination inclusive of the transparent toner image will be higher in glossiness level than the combination without the transparent toner image.

In comparison, in the field of offset printing technology, various varnishes are used as the transparent ink for blocking prevention, friction reduction, slipping prevention, glossy or matte image formation, etc. Also in the field of offset printing technology, gold colored varnish, pearl colored varnish, or the like are used to create a pseudo embossing or the like effects. Among the various effects achievable with the use of a varnish such as those mentioned above, a glossy finish or matte finish can also be achieved to some degree with the use of the toner used in the field of electrophotography, without substantially changing the materials for toner. That is, transparent toner can be used for the purposes other than for forming an image higher in glossiness level as it has been used in the past.

As examples of a glossy or matte image formed of transparent toner, there are a watermark, an eye catcher, security mark, etc. There are formed on the background area (toner free area) of an ordinary image, and are different in glossiness level from the background area.

Regarding whether to choose a glossy appearance or matte appearance, an image such as an eye-catcher, which is desired to be conspicuous, is rendered as high as possible in the contrast in glossiness relative to the recording medium.

On the other hand, a watermark is desired to be inconspicuous; a watermark is formed in such a manner that the difference in glossiness level between the water mark and the recording medium is small enough to render the watermark inconspicuous. As for a security mark, whether it is designed to be conspicuous or inconspicuous is up to the intention of the designer of the security mark. That is, sometimes, it is designed to be conspicuous, whereas other times, it is designed to be inconspicuous.

Thus, if it is possible for a designer to freely set the glossiness level at which an image forming apparatus forms a transparent mark of transparent toner, the designer can create a wide range of transparent marks in terms of glossiness level, from a transparent image which is very highly in glossiness level to a transparent image which is very low in glossiness level. In other words, if it is possible for a designer to set the glossiness level, more latitude is afforded for the design of a transparent mark.

There have been proposed a few image forming apparatuses enabled to use transparent toner, such as those listed above. One of them is disclosed in Japanese Laid-open Patent Application 2002-207334. While a photographic image is desired to be glossy, a textual image is desired to be matte, because a matte textual image is easier to read than a glossy textual image. Thus, the image forming apparatus disclosed in Japanese Laid-open Patent Application 2002-207334 is provided with a transparent image forming portion, in addition to the ordinary monochromatic color image forming portions, and is designed to allow a user to choose the area of recording medium, across which an image is to be formed of transparent, so that the portion of an image, which is desired to be glossy like a photographic, will have a top layer formed of transparent toner.

There are a few color image forming apparatuses designed to allow a user (operator) to choose the area of recording medium, onto which a transparent toner image (layer of transparent toner) is to be deposited. However, there has not been provided a color image forming apparatus designed so that the glossiness level at which it forms a transparent toner image can be changed according to the user's wishes.

More concretely, if a user wishes to form both an optically conspicuous transparent mark and an optically inconspicuous transparent mark with the use of the same image forming apparatus, a conventional image forming apparatus cannot accommodate the user's wishes.

SUMMARY OF THE INVENTION

Thus, the primary object of the present invention is to provide an image forming system which can be adjusted in the visibility level at which it forms a transparent image.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(1) Image Forming Portion

Figure 1:
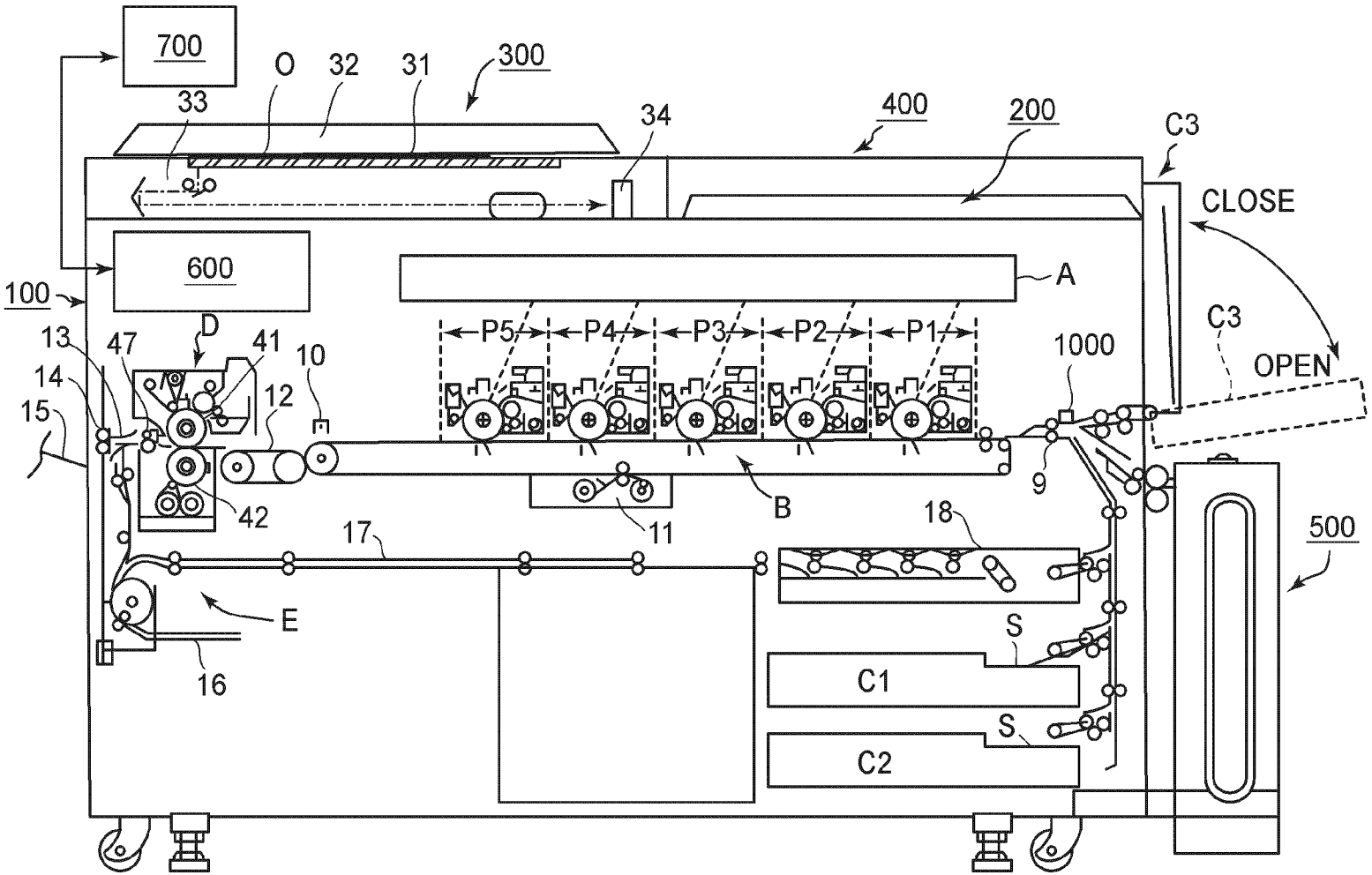
FIG. 1 is a schematic drawing of the image forming apparatus in the first embodiment of the present invention.

FIG. 1 is a schematic drawing of the image forming apparatus in this embodiment of the present invention, and shows the general structure of the apparatus. This image forming apparatus is such an apparatus that forms an image on recording medium with the use of a color toner or color toners (non-transparent toner), and a transparent toner, and fixes the color image formed of the combination of the color toner and transparent toner, to the recording medium. To describe more concretely, it is an electrophotographic recording apparatus (copying machine, printer, facsimile machine, multifunction machine capable of performing as any of preceding machines, etc.) which employs four drums arranged in tandem (in straight line).

Incidentally, this embodiment of the present invention will be described with reference to an image forming apparatus made up of an image forming portion which forms a color toner image (image form of color toner(s)), an image forming portion which forms a transparent toner image (image formed of transparent toner), and a housing in which the color toner image forming portion and transparent toner image forming portion are disposed. However, this embodiment is not intended to limit the present invention in structure. For example, the present invention is also applicable to an image forming apparatus made up of a primary image forming portion made up of an image forming portion which forms a color toner image, a fixing portion, and a housing portion in which the color image forming portion and fixing portion are disposed, and a second image forming apparatus, as an optional apparatus, which is made up of an image forming portion which forms a transparent toner image, a fixing portion, and a housing portion in which the transparent toner image forming portion and fixing portion are disposed. Here, the optional apparatus means an apparatus which can be connected to, or disconnected from, the primary image forming apparatus as necessary.

As will be evident from the description of the structural arrangement of an image forming apparatus, an image forming apparatus, which will be described later, the above described joined combination of the primary image forming apparatus and secondary image forming apparatus, will be referred to as an image forming system, in general terms.

First, the image forming portion will be described.

Designated by a referential number 100 is the main assembly (which hereafter will be referred to as apparatus main assembly) of the image forming apparatus in this embodiment. The image forming apparatus is made up of a control portion 200 (control panel), a scanner 300 (original reading portion), an area designating apparatus 400 (digitizer), which are in the top portion of the apparatus main assembly. The control portion 200 is a portion of the apparatus main assembly 100, through which a command is inputted by a user, and also, through which a user is informed of the condition (setting) of the image forming apparatus. The scanner optically reads an original. That is, it acquires an optical image of the original by scanning the original, and separates the acquired optical image into monochromatic optical images. The area designating apparatus 400 functions as a means for allowing a user to outline the area of the original (or intended image), with which the user is concerned. It also functions as a monitor on which the optical image acquired by the scanner 300 is displayed. Designated by a referential number 500 is a sheet feeder unit of a large capacity, which is located on the right side (with reference to FIG. 1) of the apparatus main assembly 100. The large capacity sheet feeder unit 500 is connected to the apparatus main assembly 100. This sheet feeder unit 500 of the large capacity is structured to be usable as one of the optional secondary apparatuses for the image forming apparatus, which can be used in combination with the apparatus main assembly 100. Designated by a referential number 600 is a controller (control circuit (CPU)), which is disposed in the apparatus main assembly 100 and controls the overall operation of the image forming apparatus. Designated by a referential number 700 is an external information inputting device (external host apparatus), such as a personal computer and a facsimile machine, which is in connection with the controller 600 through an interface.

The image forming apparatus is provided with five (first to fifth) electrophotographic image forming portions P1-P5 (which hereafter may be referred to simply as image forming portions), which are horizontally arranged in tandem in the left to right direction of the drawing. The image forming portions P1-P4 are color image forming portions, whereas the image forming portion P5 is an image forming portion for forming a transparent image.

Designated by a letter A is a laser scanner having multiple optical scanning means. Designated by a letter B is a belt type transfer system, which is under the space for the first to fifth image forming portions P1-P5. Designated by alphanumeric referential symbols C1 and C2 are two (first and second) sheet feeder cassettes (paper feeding cassettes), which are vertically stacked on the underside of the belt typed transfer system. Designated by an alphanumeric referential symbol C3 is a manual sheet feeder tray (manual sheet feeding portion), which is located on the right-hand side of the apparatus main assembly 100, in FIG. 1. When this tray 3C is not in use, it can be folded up against the apparatus main assembly 100, and kept in the position indicated in a solid line in FIG. 1, whereas when it needs to be used, it is to be opened into the position indicated by in a double-dot chain line in FIG. 1. Designated by a letter D is a fixing apparatus (which employs thermal roller(s)), which is located on the downstream side of the belt type transfer system B in terms of the recording medium conveyance direction.

The scanner 300 is made up of an original placement glass platen 31 and an original pressing plate 32. The original pressing plate 32 can be opened or closed relative to the original placement glass platen 31. An original O (which in this case is multicolor original) is to be placed on the glass platen 31 so that the image bearing surface of the original faces downward, and also, so that it is precisely positioned relative to a referential marker (line, rib, etc.). Then, the original is to be covered with the original pressing plate 32. Incidentally, the original pressing plate 32 may be replaced with an automatic sheet conveying apparatus (ADF, RDF) so that an original in the form of a sheet is automatically and accurately delivered to the preset original placement position on the original placement glass platen 31. Designated by a referential numeral 33 is an optical system, which is movable along the bottom surface of the glass platen 31. The downwardly facing surface (image bearing surface) of the original on the glass platen 31 is optically scanned by this optical system 33. As the optical system 33 is moved along the bottom surface of the glass platen 31, a beam of light is projected upon the downwardly facing surface (image bearing surface) of the original, and is reflected by the surface. The reflected beam of light is focused on a CCD 34, that is, an photo-electric transducing element (solid-state picture taking element), by which the reflected beam of light is converted into three different electrical signals, which correspond to three different colors, that is, red (R), green (G), and blue (B). The thus obtained electrical signals (which correspond to red (R), green (G), or blue (B)) are inputted into the image processing portion (unshown), which is controlled by the controller 600.

The image processing portion controls the laser type scanning system A so that a beam of laser light is outputted to the first to fourth image forming portions P1, P2, P3, and P4, while being modulated with the information (in form of electrical signals) sent to the image processing portion from the scanner 300. Incidentally, as will be described later, when the image forming apparatus is in one of the image formation modes, in which transparent toner is used, the image processing portion controls the laser type scanning system A so that not only is a beam of laser light outputted to the first to fourth image forming portions P1, P2, P3, and P4, but also, to the fifth image forming portion P5, while being modulated as described above.

When the image forming apparatus is in the printer mode, the pictorial electrical signals are inputted into the controller 600 through an interface 603 (information input junction) which is between an external host computer 700, such as a personal computer, and the controller 600, and are processed by the image processing portion, in order to make the apparatus main assembly 100 function as a printer. When the image forming apparatus is in the facsimile receiving mode, electrical pictorial information inputted into the controller 600 from the facsimile apparatus 700, that is, the facsimile machine on the facsimile sending side, through the interface 603 (information input junction) is processed by the image processing portion, in order to make the apparatus main assembly 100 function as facsimile receiving apparatus. When the image forming apparatus is in the facsimile sending mode, electrical pictorial information of the original, which was photo-electrically read by the scanner 300, is transmitted to the facsimile apparatus 700 on the receiving side through the interface 603 (information input junction) The interface portion 603 also plays the role of receiving the electrical information for selecting one of the image formation modes, which will be described later.

Figure 2:
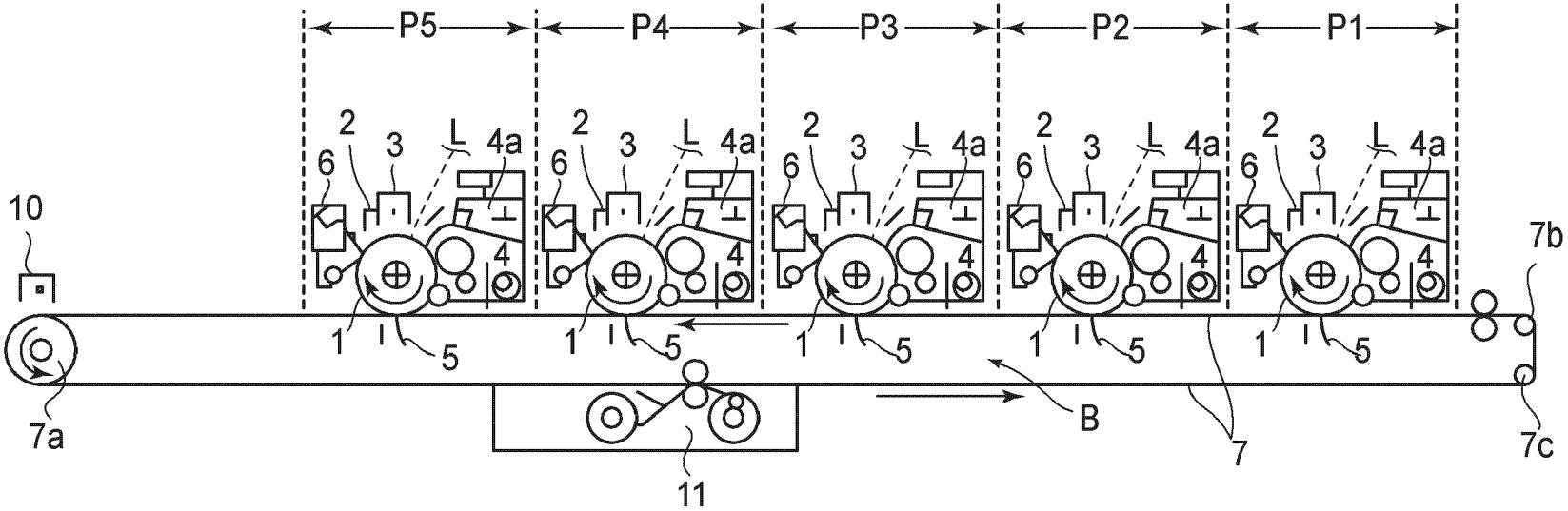
FIG. 2 is an enlarged schematic drawing of the portions of the image forming apparatus, which pertain to the present invention.

FIG. 2 is an enlarged schematic drawing of the first to fifth image forming portions P1-P5, and the belt type transferring system B. The first to fifth image forming portions P1-P5 are the same in the structure for carrying out an electrophotographic process. Each image forming portion has an electrophotographic photosensitive drum 1 (which hereafter will be referred to simply as drum 1), which serves as an image bearing member. It also has a full exposure lamp 2 (charge removing lamp), a primary charging device 3, a developing device 4, a transfer charging device 5, a drum cleaner, etc., which are processing means for processing the drum 1.

The developing device 4 in each of the first to fifth image forming portions P1-P5 is a developing device which utilizes a magnetic brush. It uses two-component developer, that is, a combination of toner and magnetic particles.

The developer 4 of the first image forming portion P1 stores two-component developer, which is a mixture of toner of cyan color (cyan (C) toner) and magnetic carrier particles. The image forming apparatus is controlled so that as the cyan (C) toner in the developing device 4 of the first image forming portion P1 is consumed, cyan (C) toner is supplied to the developing device 4 to keep the developer in the developing device 4 stable in toner density at a preset level.

The developer 4 of the second image forming portion P2 stores two-component developer, which is a mixture of toner of magenta color (magenta (M) toner) and magnetic carrier particles. The image forming apparatus is controlled so that as the magenta (M) toner in the developing device 4 of the second image forming portion P2 is consumed, magenta (M) toner is supplied to the developing device 4 to keep the developer in the developing device 4 stable in toner density at a preset level.

The developer 4 of the third image forming portion P3 stores two-component developer, which is a mixture of toner of yellow (Y) color (yellow (Y) toner) and magnetic carrier particles. The image forming apparatus is controlled so that as the yellow (Y) toner in the developing device 4 of the third image forming portion P3 is consumed, yellow (Y) toner is supplied to the developing device 4 to keep the developer in the developing device 4 stable in toner density at a preset level.

The developer 4 of the fourth image forming portion P4 stores two-component developer, which is a mixture of toner of black color (black (K) toner) and magnetic carrier particles. The image forming apparatus is controlled so that as the black (K) toner in the developing device 4 of the fourth image forming portion P4 is consumed, black (K) toner is supplied to the developing device 4 to keep the developer in the developing device 4 stable in toner density at a preset level.

The developer 4 of the fifth image forming portion P5 stores two-component developer, which is a mixture of transparent (T) toner and magnetic carrier particles. The image forming apparatus is controlled so that as the transparent toner T in the developing device 4 of the fifth image forming portion P5 is consumed, transparent (T) toner is supplied to the developing device 4 to keep the developer in the developing device 4 stable in toner density at a preset level.

The belt type transfer system B comprises an endless transfer belt 7, and multiple rollers, namely, a driver roller 7*a* and a pair of turn rollers 7*b* and 7*c*, around which the transfer belt 7 is stretched. A recording medium is conveyed by the transfer belt 7 to a transfer portion, in which the recording medium faces the drum 1 of each image forming portion. The transfer belt 7 is circularly moved by a motor (unshown). That is, as the driver roller 7*a* is rotationally driven by the motor (unshown) through a driving force transmitting apparatus, such as a timing belt or the like, the transfer belt 7 circularly moves in the counterclockwise direction indicated by an arrow mark, at a preset velocity.

The operation carried out by this image forming apparatus to form a full-color image is as follows. First, the first to fifth image forming portions P1-P5 are sequentially driven with preset control timing. As each image forming portion is driven, the drum 1 of the image forming portion rotates in the clockwise direction indicated by an arrow mark. At the same time, the transfer belt 7 of the belt type transfer system B is circularly driven, along with the laser type scanning system A. In synchronism with the driving of the abovementioned components, the primary charging device 3 uniformly charges the peripheral surface of the drum 1 to preset polarity and potential level. The laser type scanning system A scans the charged area of the peripheral surface of the drum 1, with a beam of laser light L which it emits while modulating the beam of laser light with electrical pictorial signals. As a result, an electrostatic latent image, which reflects the electrical pictorial signals, is formed on the peripheral surface of the drum 1. More specifically, the laser type scanning system A is made up of a light source (unshown), a polygon mirror (unshown), a deflection mirror (unshown), and an f-θ lens (unshown) The beam of laser light L emitted from the light source is projected upon the polygon mirror which is being rotated. Thus, the beam of laser light L is deflected by the polygon mirror, being thereby moved in a scanning manner. Then, the beam of laser light L is changed in direction by the deflection mirror, and focused by the f-θ lens on the charged area of the peripheral surface of the drum 1 in a manner to scan the area. As a result, an electrostatic latent image, which reflects the electrical pictorial signals, is formed on the drum 1. This electrostatic latent image is developed by the developing device 4 into a toner image, that is, an image formed of toner.

Through the above described electrophotographic process, a cyan (C) color toner image, which corresponds to the cyan component of the full-color image, is formed on the peripheral surface of the drum 1 of the first image forming portion P1. On the peripheral surface of the drum 1 of the second image forming portion P2, a magenta (M) color toner image, which corresponds to the magenta component of the full-color image, is formed on the peripheral surface of the drum 1 of the second image forming portion P2. On the peripheral surface of the drum 1 of the third image forming portion P3, a yellow (Y) color toner image, which corresponds to the yellow component of the full-color image, is formed on the peripheral surface of the drum 1 of the third image forming portion P3. On the peripheral surface of the drum 1 of the fourth image forming portion P4, a black (K) color toner image, which corresponds to the black component of the full-color image, is formed on the peripheral surface of the drum 1 of the fourth image forming portion P4. Further, in the image formation mode in which transparent toner is used, an image forming operation similar to the image forming operation carried out by the first to fourth image forming portions is carried out by the fifth image forming portion P5 to form a transparent (T) toner image, which corresponds to the information of the transparent image to be formed, is formed on the peripheral surface of the drum 1.

The above described first to fourth image forming portions P1-P4 make up a full-color image forming means which forms a full-color image with the use of multiple color toners. The fifth image forming portion P5 is an image forming means which forms a transparent image.

Meanwhile, one among the first sheet feeder cassette C1, second sheet feeder cassette C2, manual sheet feeder tray C3, and large capacity sheet feeder unit 500 is selected, and the sheet feeder roller of the selected sheet feeding means is driven. As the sheet feeder roller is driven, one of the sheets of recording mediums S stored in the selected sheet feeding means is fed into the apparatus main assembly 100. Then, the sheet of recording medium S (which hereafter will be referred to simply as recording medium S) is delivered onto the transfer belt 7 of the belt type transfer system B by way of multiple conveyance rollers and a pair of registration rollers 9. Then, the recording medium S is conveyed by the transfer belt 7 sequentially through the transfer portions of the first to fifth image forming portion P1-P5.

The transfer belt in this embodiment is the transfer belt 7, which is a means for conveying the recording medium S. However, an image forming apparatus may be structured so that an intermediary transfer belt is employed in place of the transfer belt 7. In the case of an image forming apparatus provided with an intermediary transfer belt, the toner images formed in the image forming portions are sequentially transfer (primary transfer) in layers, onto the intermediary transfer belt, in the transfer portions, and then, are transferred together (secondary transfer) onto the recording medium S.

The transfer belt 7 is circularly driven as described above. The moment it is confirmed that a preset referential point of the transfer belt 7 has passed by a preset point of the loop which the transfer belt 7 forms, the recording medium S is released and conveyed by the registration rollers 9 onto the transfer belt 7, and then, is conveyed by the transfer belt 7 toward the transfer portion of the first image forming portion P1. At the same time, an image writing start signal is turned on. In response to the image writing start signal, an operation for forming an image on the drum 1 of the first image forming portion P1 is started with a preset timing. Further, the transfer charging device 5 generates an electric field in the transfer portion, which is on the bottom side of the drum 1, or gives electric charge to the recording medium S, as the recording medium S is conveyed through the transfer portion. Thus, the toner image formed of the toner of the first color, that is, cyan (C) color, on the drum 1 transfers onto the recording medium S. Through this transfer process, the recording medium S becomes securely held to the transfer belt 7 by electrostatic force. Then, the recording medium S is conveyed further sequentially through the transfer portions of the second image forming portion P2 and the image forming portions on the downstream side of the second image forming portions P2 in terms of the direction in which the recording medium P is conveyed. While the recording medium S is conveyed through the second to fourth image forming portions P2, P3, and P4, respectively, the toner image of magenta (M) color, toner image of yellow (Y) toner, and toner image of black (K) color, are sequentially transferred onto the recording medium S from the drums 1 of the image forming portions P2, P3, and P4, as they are formed on the drums 1, respectively. As a result, a single unfixed full-color image (made up of monochromatic cyan toner image, monochromatic magenta toner image, monochromatic yellow toner image, and black toner image) is synthetically effected on the recording medium S. When the image forming apparatus is in the image forming mode which uses transparent toner as well as the color toners, a toner image formed of transparent (T) toner is formed on the drum 1 of the fifth image forming portion P5. As the transparent toner image is formed, it is transferred onto the recording medium S in the transfer portion of the fifth image forming portion P5.

After the synthetical formation of a single full-color image made up of four monochromatic toner images of cyan (C), magenta (M), yellow (Y), and black (K) colors, one for one, or the addition of a transparent toner image upon the full-color image, the recording medium S is conveyed further downstream of the transfer belt 7 in terms of the direction in which the recording medium S is conveyed by the transfer belt 7, to the separation charging device 10, which removes electric charge from the recording medium S, reducing the electrostatic force which has kept the recording medium S adhered to the transfer belt 7. Thus, the recording medium S is separated from the transfer belt 7 at the downstream end of the transfer belt loop. Designated by a referential number 11 is a cleaning apparatus for cleaning the surface of the transfer belt 7.

As the recording medium S separates from the transfer belt 7, it is introduced by the conveyer belt 12 into the fixing apparatus D, and is conveyed through the fixation nip portion of the fixing apparatus D. As the recording medium S is conveyed through the fixation nip portion between the fixation roller 41 and pressure roller 42 of the fixing apparatus D while remaining pinched by the rollers 41 and 42, it is subjected to heat and pressure. As a result, the toner images become fixed to the recording medium S. Thereafter, the recording medium S is conveyed further by a pair of fixation roller 47, which are on the immediate downstream side of the fixing apparatus D. Then, the recording medium S is moved on the top side of a selector 13, and is conveyed further by a pair of discharge rollers 14, while remaining pinched by the pair of discharged rollers 14, to be discharged into a delivery tray 15, which is located outside the apparatus main assembly 100.

When the image forming apparatus is in the two-sided image formation mode, the recording medium S is conveyed in the following manner: As the recording medium S is conveyed out of the fixing apparatus D after the image formation on its first surface, it is directed by the selector 13 toward a reversing and re-feeding system E. Then, the recording medium S is put upside down by the reversing portion 16 (switchback system) of the reversing and re-feeding system E. Then, it is conveyed to a two-sided image formation passage 17, and is temporarily held in an intermediary tray 18. Then, it is moved out of the intermediary tray 18 toward the pair of registration rollers 19 by a sheet feeder roller which is driven with preset control timing. Then, it is delivered for the second time onto the transfer belt 7 of the belt type transfer system B, with its second surface facing upward. Then, another unfixed full-color toner image is synthetically formed on the second surface of the recording medium S by the first to fifth image forming portions P1-P5 as the first unfixed full-color toner image was formed on the first surface of the recording medium S. After the reception of the second unfixed toner image(s) on the second surface of the recording medium S, the recording medium S is separated from the transfer belt 7, and is conveyed to the fixing apparatus D, in which the toner image(s) on the second surface of the recording medium S is fixed.

This image forming apparatus is capable of outputting a monochromatic image of any of the aforementioned colors, and also, a black-and-white image. The image forming operation for outputting a monochromatic image (inclusive of black-and-white image) is as follows: As the monochromatic image formation mode is selected, only the image forming portion, among the first to fifth image forming portions P1-P5, which corresponds to the selected color, is used for image formation; the other image forming portions are not used for image formation although their drums are rotationally driven. Then, a sequence for transferring a toner image onto the recording medium S, which is being conveyed by the belt type transfer system B through the transfer portion of the selected image forming portion, that is, the transfer portion of the activated image forming portion, is carried out.

Figure 3:
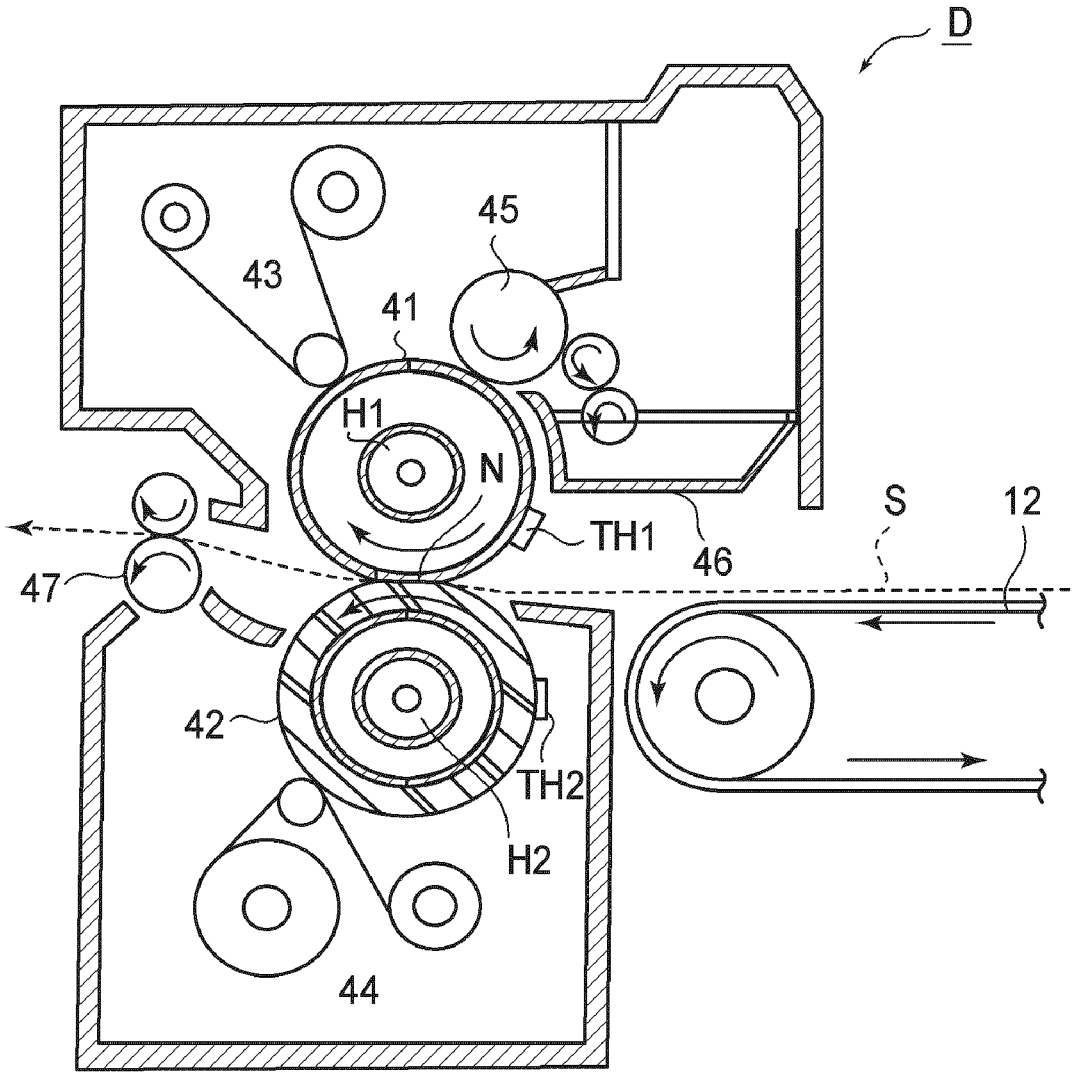
FIG. 3 is an enlarged schematic drawing of the fixing apparatus portion in the image forming apparatus in the first embodiment.

FIG. 3 is a schematic enlarged view of the fixing apparatus D, which is the image fixing portion of the apparatus main assembly 100. The fixing apparatus D is of the thermal roller type. It has a fixation roller 41 (fixing member) and a pressure roller 42 (pressure applying member), which are kept pressed against each other, forming a fixation nip N. The fixation roller 41 and pressure roller 42 are rotationally driven in the direction which matches the direction in which the recording medium S is conveyed. Further, the fixing apparatus D is provided with a pair of heat resistant cleaning members 43 and 44, which are for cleaning the fixation roller 41 and pressure roller 42, respectively. The fixing apparatus D is also provided with a roller 45 for coating the fixation roller 41 with a recording medium (sheet) releasing agent, such as dimethyl silicone oil, and a reservoir 46 for the recoding medium (sheet) releasing agent (recording medium (sheet) releasing oil).

The fixation roller 41 is made up of three portions, more specifically, a cylindrical core, a cylindrical elastic layer, and a cylindrical recording medium releasing layer (which hereafter will be referred to simply as release layer), which are coaxial. The core is a piece of aluminum pipe, which is 44 mm in diameter and 5 mm in wall thickness. The elastic layer is made of silicon rubber, and is 50 degrees in JIS-A hardness scale and is 2.5 mm in thickness. The release layer is formed of PFA and is 50 μm in thickness. The fixation roller 41 is provided with a halogen lamp H1, which is disposed as a heat source (heat generating member) in the hollow of the core.

The pressure roller 42 is similar in structure to the fixation roller 41, although its elastic layer, which also is made of silicone rubber, is 3 mm in thickness in order to add to the fixation nip width in terms of the recording medium conveyance direction. It is also provided with a halogen lamp H2, which is disposed in the hollow of its core.

For the longevity of the fixation roller 41 and pressure roller 42, a piece of roughly 30-50 μm thick PFA tube may be fitted over each of the two rollers in a manner to cover its release layer.

The fixation roller 41 and pressure roller 42 are kept pressed upon each other, forming the fixation nip N, in which the recording medium S and the toner images thereon are subjected to heat and pressure. The fixation nip N has a preset width in terms of the recording medium conveyance direction. More specifically, the pressure roller 42 is kept pressed upon the fixation roller 41 so that 490 N (50 kgf) of contact pressure is maintained in the fixation nip N. The abovementioned width of the fixation nip N is 7 mm.

The controller 600 detects the surface temperature level of the fixation roller 41 and that of the pressure roller 42 with use of temperature detection elements TH1 and TH2, respectively. In response to the detected surface temperature level of each of the two rollers, the controller 600 controls the amount of the electric power to be supplied to the halogen heaters H1 and H2, in such a manner that the temperature level in the fixation nip N remains at a preset value (for example, roughly 180° C.).

As the recording medium S is introduced into the fixing apparatus D, it is advanced into the fixation nip N, and is conveyed through the fixation nip N while remaining pinched by the fixation roller 41 and pressure roller 42. As the recording medium S is conveyed through the fixation nip N, the recording medium S and the toner images thereon are subjected to heat and pressure. As a result, the toner images become fixed to the recording medium S while mixing. The fixation speed is 200 mm/sec.

(2) Color Toner and Transparent Toner

Both color toner and transparent toner can be manufactured by pulverization.

As the binder resin used for manufacturing particulate toner, it is possible to use homopolymers of styrene or its substitution products, such as polystyrene and polyvinyl toluene. It is also possible to use styrene-based copolymers, such as a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinylmethyl ether copolymer, a styrene-vinylethyl ether copolymer, a styrene-vinylmethyl ketone copolymer, a styrene-butadiene copolymer, a styrene-isoprene copolymer, a styrene-maleic acid copolymer, and a styrene-maleate copolymer. Further, it is possible to use polymethylmethaclylate, polybutylmethaclylate, polyvinyl acetate, polyethylene, polypropylene, polyvinyl butyral, silicone resin, polyester resin, polyamide resin, epoxy resin, and polyacrylic resin. These polymers or resins can be used singly or in mixture of two or more species. Particularly, the styrene copolymers and the polyester resin may preferably be used from the standpoints of a developing characteristic, fixability, and the like.

As the preferable methods for manufacturing the toners used in this embodiment, suspension polymerization, interfacial polymerization and dispersion polymerization, which directly yields particulate toner in a medium, can be listed.

In the case of these types of polymerization, polymeric monomer, a combination of polymeric monomer and a coloring agent (plus, polymerization initiator, bridging agent, charge controlling agent, and the like additives, if necessary) is homogeneously dissolved or dispersed in a medium, yielding monomeric compound. Then, the thus obtained monomeric compound is dispersed in a continuous layer (for example water phase) which contains a dispersion stabilizer, with the use of an appropriate stirring device, while allowing the combination to polymerize, to obtain a particulate toner, the particle diameter of which has a desired value.

The toner is desired to contain a release agent, for example wax. Mixing the toner with a proper amount of wax as a release agent makes it possible to prevent the toner from being welded to a photosensitive member, while achieving a high level of resolution and a high level of offset resistance.

In a case where toner is manufactured by polymerization, the following may be listed as the primary polymeric monomer as the binder resin:

Monomers, such as styrene, o-methylstyrene, m-methylstyrene, p-methylstyrene, p-methoxystyrene, etc., which belong to styrene group. Also can be listed as the polymeric monomers are acrylic esters, for example, methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate. In addition, acrylic ester, such as 2-chlorethyle acrylate, phenyl acrylate, etc., can also be listed. Further, methacrylic ester, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethyl-aminoethyl methacrylate, diethyl-aminoethyl methacrylate, etc., may be listed. Moreover, monomers, such as acrylonitrile, methacrylonitrile, acrylamide, etc., may be listed. These monomers can be used alone or in mixture. From the standpoint of the developmental properties and durability of a color toner, it is preferable to use styrene or styrene derivative, alone or in combination with any of the above listed monomers.

Further, the toner used in this embodiment is desired to contain polyester resin, which is desired to be in a range of 6,000-100,000 in weight average molecular weight (Mw). A polyester resin which is no more than 600 in weight average molecular weight is not effective to prevent external additives from being embedded into a toner particle, being therefore not effective to prevent the problem that with the increase in the cumulative amount of usage, toner reduces in the amount of electric charge it can hold. On the other hand, if the toner contains a polyester resin which is no less than 100,000 in weight average molecular weight, resins formed by condensation is less unlikely to properly disperse in the particular toner. Thus, such a particular toner that is broader in the particle diameter distribution is likely to be yielded.

Whether polymerization method or pulverization method is used, the glass transition point (Tg) of the binder resin is desired to be in a range of 40° C.-70° C., preferably, in a range of 45° C.-65° C. Thus, the above listed monomers is used alone or in mixture so that the theoretical glass transition point (Tg), presented in a publication, such as Polymer Handbook, Second Edition III, p. 139-192 (John Wiley & Sons, Co., Ltd.), of the resultant particulate toner will be in the range of 40° C.-70° C.

A color toner contains a coloring agent to provide the above listed substances (binders) with color. The preferable organic pigments or dyes for this embodiment are listed below. Incidentally, transparent toner does not contain a coloring agent. Before fixation, transparent sometimes appears whitish. But, as it is fixed, it turns virtually colorless and transparent.

As the organic pigments or organic dyes for cyan coloring agents, copper-phthalocyanine compounds and their derivatives, anthraquinone compounds, basic dye-lake compound, etc., can be used.

As the organic pigments or organic dyes for magenta coloring agents, condensation azo compounds, diketopyrrolopyrrole compounds, anthraquinone compounds, quinacridone compounds, basic dye-lake compounds, naphthol compounds, benzimidazolone compounds, thioindigo compounds, and perylene compounds can be used.

As the organic pigments or organic dyes for yellow coloring agents, condensation azo compounds, isoindolinone compounds, anthraquinone compounds, azo metal complexes, methine compounds, and allylamido compounds can be used.

As the coloring agent for black toner, carbon black or the like can be listed.

These coloring agents can be used individually or in combination. Further, they can be used in a solid form or a liquid form. The coloring agents used for the color toners are to be selected based on the hue angle, saturation, brightness, light fastness, OHP transparency, and dispersibility (in toner materials).

The amount in mass by which the coloring agent is to be added to the binder resin is 1-20 parts relative to 100 parts of the binder resin.

In order to stabilize toner in its properties related to electric charge, a charge controlling agent may be added to toner. As the charge controlling agent, any known charge controlling agent may be used, although those which are high in charge speed and can maintain a certain amount of electric charge, are preferable.

In a case where a particulate toner is manufactured by polymerization, the following operation is carried out: Generally, a coloring agent, a releasing agent, a charge controlling agent, a bridging agent, etc., which are necessary to form the toner, and the other additives, are added by a proper amount to the polymeric monomer, that is, binder compound. Then, the mixture is made homogeneous with the use of a homogenizer, a ball mill, a choroid mill, an ultrasonic dispersing machine, etc. Then, the homogenized mixture of the polymeric monomer and the abovementioned ingredients, is suspended in a body of water-based medium which contains a dispersion stabilizer.

As the means for manufacturing particulate toner, any known method may be used, for example, the following one. That is, the binder resin, releasing agent, charge controlling agent, coloring agent, etc., which are necessary for manufacturing a particulate toner, and additives, are thoroughly mixed with the use of a mixing device, such as a Henschel mixer and a ball mixer. Then, the mixture is melted, while being mixed, by a thermal kneading machine, such as a heating roll, a kneader, and an extruder. Then, the mixture is cooled to solidify the mixture. The solidified mixture is pulverized, and classified, obtaining the desired particulate toner. The thus obtained particulate toner may be subjected to a surface treatment, as necessary. It does not matter which process is carried out first, the classifying process or surface treatment. For manufacturing efficiency, it is desired that a multi-class classifying machine is used for the classifying process.

As for the apparatus to be used for the pulverization, any of known pulverizing apparatuses, for example, a pulverizing apparatus of the jet type, may be used. If it is necessary to obtain a particulate color toner which has a specific value in sphericity, it is desired that the particular toner obtained through the above described steps is subjected to an additional pulverizing process while being heated and/or being subjected to mechanical impact as auxiliary pulverizing means. Further, after the abovementioned solidified mixture (precursor) of the particulate toner is pulverized into microscopic color toner particles (and classified as necessary), the color toner particles may be dispersed in hot water (hot water bath), or passed through a body of hot air.

Further, the microscopic inorganic particles (external additives) which the particulate toner is desired to contain are desired to be 4-80 nm in primary average particle diameter. Addition of microscopic hydrophobic inorganic particles to the particulate toner enables the toner to remain high in the amount of electric charge, being prevented from scattering, even in an environment which is high in humidity. As examples of the microscopic inorganic particles usable for the above described purpose, silica, alumina, titania, and the like are available.

The composition of the cyan (C) toner, magenta (M) toner, yellow (Y) toner, black (K) toner, and transparent (T) toner, which are used in the first to fifth image forming portions P1-P5 of the image forming apparatus in this embodiment is as follows:

Cyan (C) toner: 100 parts in weight of polyester (main binder) which is roughly 5,000 in numerical average molecular weight, 5 parts in weight of phthalocyanine pigment, four parts in weight of charge controlling agent, and external additive(s).

Magenta (M) toner: 100 parts in weight of polyester (main binder) which is roughly 5,000 in numerical average molecular weight, 4 parts in weight of C.I. solvent red pigment, 0.7 part in weight of C.I. pigment red 122, four parts in weight of charge controlling agent, and external additive(s).

Yellow (Y) toner: 100 parts in weight of polyester (main binder) which is roughly 5,000 in numerical average molecular weight, 5 parts in weight of pigment (C.I. pigment yellow 17), four parts in weight of charge controlling agent, and external additive(s).

Black (K) toner: 100 parts in weight of polyester (main binder) which is roughly 5,000 in numerical average molecular weight, 5 parts in weight of carbon black, four parts in weight of charge controlling agent, and external additive(s).

Transparent (T) toner: 100 parts in weight of polyester (main binder) which is roughly 5,000 in numerical average molecular weight, four parts in weight of charge controlling agent, and external additive(s).

The above described five toners are mixed with particulate magnetic carrier, yielding five two-component developers, which are different in color.

All five toners are roughly 55° C. in glass transition point (Tg). The glossiness level of the color toners after fixation, which was measured with the use of a 60° was roughly 40%.

The glossiness level was measured with the use of a Glossmeter (PG-1M), a product of Nippon Denshoku Co., Ltd. (JIS Z 8741: mirror surface glossiness level measuring method).

(3) Image Formation Mode Which Uses Transparent Toner

The image forming apparatus in this embodiment has an image formation mode in which the image forming apparatus forms an image of transparent toner. This mode hereafter will be referred to as the transparent toner mode. The transparent toner mode has two sub-modes, that is, a full coverage sub-mode and a partial coverage sub-mode.

The full coverage sub-mode of the transparent toner mode is such a sub-mode that a transparent toner image is formed to yield a print (copy) which is practically uniform in the combined thickness of the four monochromatic toner images, different in color, and one transfer toner image. That is, in this sub-mode of the transparent toner mode, a transparent toner image is formed so that the recesses (valleys) which are created as the monochromatic color toner images are transferred onto the recording medium S are filled with transparent toner as the transparent toner image is transferred onto the recording medium S, in order to render virtually uniform the entire area of the recording medium, across which an image can be formed, in the combined thickness of the four monochromatic toner images and one transparent toner image.

As will be evident from the description given above, in the full coverage transparent toner mode, the image formation setting is not changed to change the glossiness level at which a transparent image is formed, as in the partial coverage transparent toner mode, which will be described later. That is, the full coverage transparent toner mode is the mode for yielding a print (copy) which is glossy across the entirety of the image formation area of the recording medium.

The partial coverage transparent toner mode is a mode for forming a transparent image, such as a letter, an insignia, a pictorial pattern, etc., in addition to a monochromatic or multicolor toner image, on the recording medium S. That is, it is a mode for forming various transparent images, such as the abovementioned transparent letter, insignia, pictorial pattern, etc., which different in glossiness level, that is, from being very low to being very high in glossiness level, as will be described later.

Figure 5:
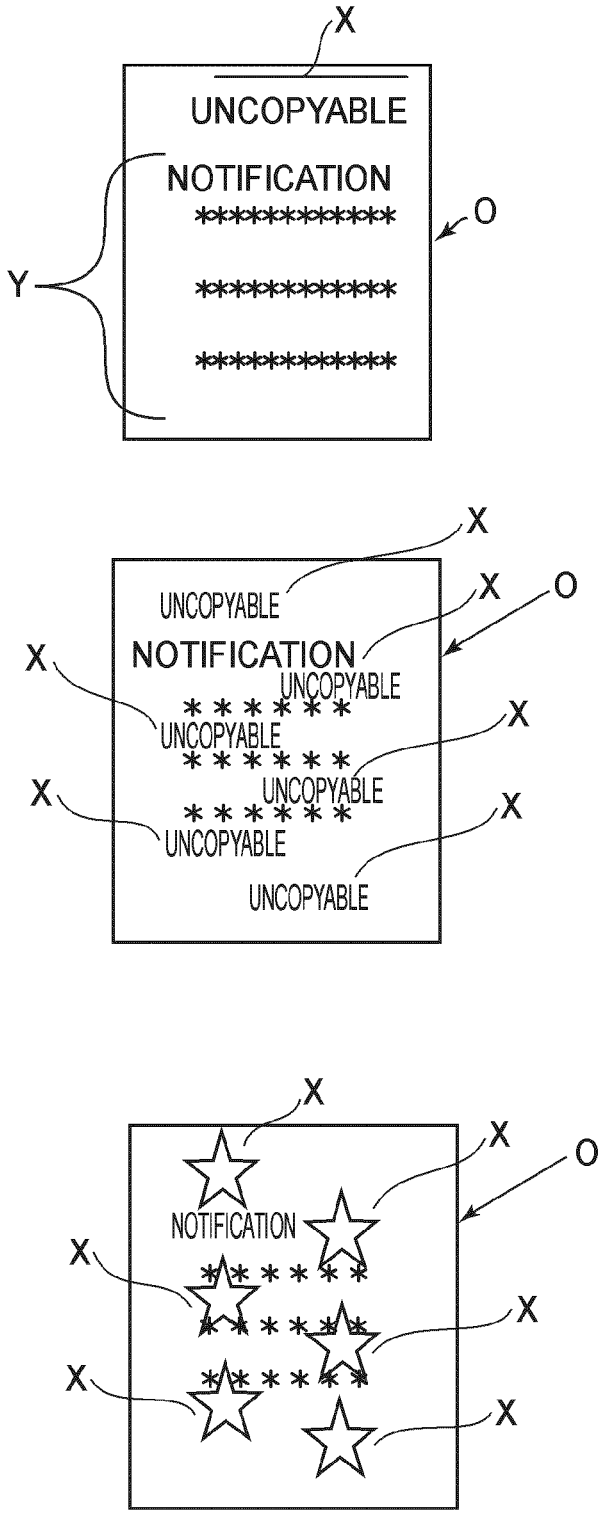
FIG. 5(*a*)-5(*c*) is drawings of three prints, one for one, which have transparent marks.

Examples O of a print outputted in the partial coverage transparent toner mode are given in FIG. 5. In FIG. 5(*a*), the area designated by a letter Y, is the area across which an ordinary color toner image (which in this embodiment is black toner image) was formed. That is, it corresponds to the textual advertisement portion of a leaflet (publication). An area such as the above described area of the print is also present in FIGS. 5(*b*) and 5(*c*).

On the other hand, the areas designated by a letter X in FIG. 5 are the portions of the areas designated by the letter Y, that is, the areas across which the ordinary image was formed, and also, across which a warning, that is, a "no copying" sign was added. In the case of the print shown in FIG. 5(*b*), several "no copying" signs were printed across the blank areas of the ordinary image. In the case of the print shown in FIG. 5(*c*), several marks which are in the shape of a star have been added in place of the "no copying" signs.

In other words, the partial coverage transparent toner mode in this embodiment is an image formation mode which can answer the user's desire to yield a print having the conspicuous "no copying" signs or star-shaped marks, which are formed of the transparent toner, or a print having inconspicuous "no copying" signs or star-shaped marks, which are also formed of the transparent toner. Thus, the image forming apparatus in this embodiment is designed so that it can be changed in the glossiness level at which it forms the "no copying" sign or star-shaped mark.

Hereafter, the full coverage transparent toner mode and partial coverage transparent toner mode will be described in detail.

A: Full-coverage Transparent Toner Mode

Figure 6:
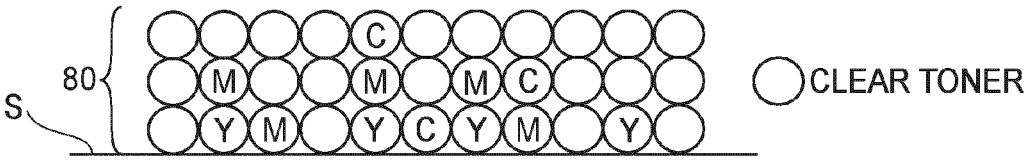
FIG. 6 is a schematic vertical sectional view of the toner layers on recording medium, which were formed in the full coverage transparent toner mode.

FIG. 6 is a schematic drawing of the toner layers formed on the recording medium S. In this embodiment, the maximum amount by which toner is deposited on the recording medium S per unit area of a toner layer 80 made up of the four color toners, different in color, is 1.5 mg/cm$^2$. The maximum amount by which each color toner can be deposited per unit area of the recording medium S is 0.5 mg/cm$^2$. FIG. 6 is a schematic vertical sectional view of a given area of the multicolor image formed of the color toners (yellow (Y), magenta (M), cyan (C), and black (K) toners, in the full coverage transparent toner mode. Generally, the yellow (Y) toner image, magenta (M) toner image, and cyan (C) toner image among the layered yellow (Y), magenta (M), cyan (C), and black (K) toner images which make up a single full-color (multicolor) image, can be partially or entirely replaced with black (K). Obviously, a monochromatic black toner image, that is, a black-and-white toner image can be formed of black (K) toner alone.

Further, in this embodiment, onto the areas of the image formation area of the recording medium S, which are smaller in the amount of the color toners deposited thereon than 1.5 mm/cm$^2$, the transparent toner is transferred to make the entirety of the image formation area of the recording medium S uniform in the total amount of toners (sum of three color toners and one transparent toner), at 1.5 mg/cm$^2$.

As for the means for transferring the transparent toner as described above, a transparent image is formed in the following manner. That is, the controller 600 calculates the thickest portion of the image to be formed of the color toners, on the surface of the recording medium S, with the use of an image thickness calculating portion, from the data of the image to be formed. Then, the controller 600 calculates the amount by which the transparent toner needs to deposited on the point of the recording medium S, which corresponds to each pixel of the image to be formed, based on the difference between the abovementioned thickest point of the image to be formed, and the value of the maximum amount, per unit area, by which the combination of the five toners is to be deposited on the recording medium S. Then, the controller 600 makes the image forming apparatus form a transparent toner image on the peripheral surface of the drum 1 so that as the transparent image is transferred onto the recording medium S, the recesses which have been created by the color toners will be filled up with the transparent toner to eliminate the recesses. As described above, the image forming portion which uses the transparent toner forms an electrostatic latent image by exposing the drum 1 based on the information regarding the toner images to be formed in the other image forming portions (color image forming portions), and then, forms a transparent toner image by developing the electrostatic latent image with the use of the transparent toner.

As described above, the full coverage transparent toner mode is to be used to yield a print (copy) which is higher in glossiness level across the entirety of the image formation area of the recording medium S than an ordinary print (copy).

B: Partial Coverage Transparent Toner Mode

The image forming apparatus in this embodiment is provided with the partial coverage transparent toner mode, that is, a transparent toner mode which is different from the full coverage transparent toner mode, that is, the mode which uses the transparent toner to yield a print (copy) which is uniform in the thickness of the full-color image or monochromatic image on the recording medium.

The partial coverage transparent toner mode is to be used to form a transparent mark (marks), for example, a watermark, an eye catcher, a security mark, etc., which are in the form of a letter, a sign, a specific pattern, a nonspecific pattern, and a combination of the preceding markings, etc.

In this embodiment, a transparent image is formed on the area of the recording medium S, which does not correspond to the area of the recording medium S, which is covered with the color toners. However, a transparent image, such as a letter, may be formed on the area of the recording medium S, which is covered with the color toners. Also, the image forming apparatus in this embodiment is designed so that it can be adjusted in the glossiness level for the transparent portion of an image, which is to be formed of the transparent toner, as will be described later. Obviously, a transparent image is transparent. However, in some cases, a transparent image is desired to be conspicuous, whereas in other cases, it is desired to be inconspicuous. This is why the image forming apparatus in this embodiment is afforded more latitude in the glossiness level range in which it can form an image of the transparent toner, in order to accommodate the abovementioned desires.

(4) Glossiness Level Selection for Image Portion Covered with Transparent Toner

The image forming apparatus in this embodiment is provided with a matte mode (first image formation mode), that is, a mode for forming an image which is relatively low in glossiness level across the areas covered with the transparent toner, and a gloss mode (second image formation mode), that is, a mode for forming an image which is relatively high in glossiness level across the areas covered with the transparent toner. Further, it is designed to allow a user to chose either of the two modes. Obviously, the image forming apparatus may be provided with an intermediary gloss level mode, that is, a mode for forming an image which is higher in glossiness level than that formable in the matte mode, but, lower in glossiness level than that formable in the gloss mode, across the areas covered with the transparent toner, in addition to the abovementioned two modes.

The inventors of the present invention discovered that an image forming apparatus can be changed in the glossiness level for an image to be formed of the combination of the color toners and transparent toner, by changing the image formation settings of the image forming apparatus, without changing the transparent toner in properties. Thus, the image forming apparatus in this embodiment is characterized in that it is provided with an image formation mode selecting means which allows a user to select a specific glossiness level at which the image forming apparatus forms a glossy image in the partial coverage transparent toner mode, so that when a transparent image is formed, the image formation settings can be changed according to the information regarding the selected glossiness level.

For example, in the partial coverage transparent toner mode for forming a letter with the use of the transparent toner, the image forming apparatus can be changed in the settings for forming the latent image which corresponds to the transparent toner image to be formed, according to the information regarding the data for the letter portion of the transparent image. In the partial coverage transparent toner mode for forming a sign with the use of the transparent toner, the image forming apparatus can be changed in the settings for forming the latent image for the transparent toner image to be formed, according to the information regarding the data for the sign portion of the transparent image. In the partial coverage transparent toner mode for forming a pictorial pattern with the use of the transparent toner, the image forming apparatus can be changed in the settings for forming the latent image for the transparent image to be formed, according to the information (data) regarding the pictorial pattern of the image to be formed.

Next, the control panel 200, which also functions as the mode selecting portion for selecting the partial coverage mode, and also, as the mode selecting means for selecting the glossiness level when the image forming apparatus is in the partial coverage transparent toner mode, will be described.

Figure 4:
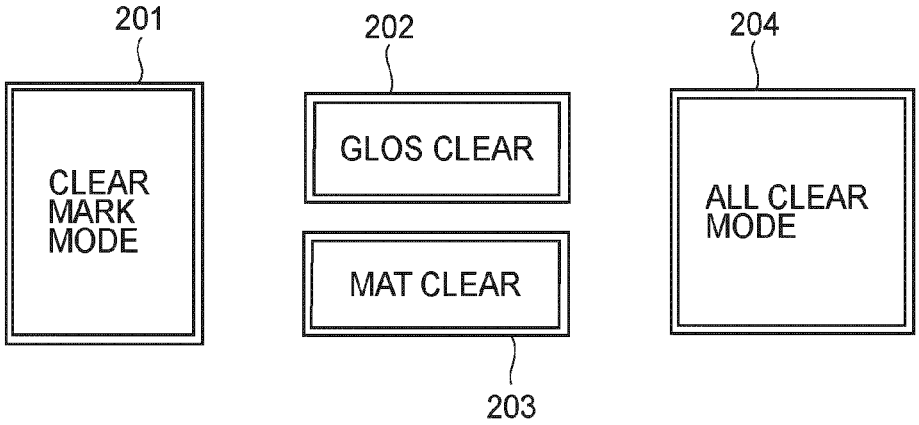
FIG. 4 is a schematic plan view of the control panel portion of the image forming apparatus.

Referring to FIG. 4, the control panel 200 is provided with a transparent mark button 201, which is the portion for choosing the partial coverage transparent toner mode. Pressing the button 201 once places the image forming apparatus in the partial coverage transparent toner mode, and illuminates the button 201 to indicate that the image forming apparatus is in the partial coverage transparent toner mode. Pressing the button 201 for the second time moves the image forming apparatus out of the partial coverage transparent toner mode, and turns off the illumination for the button 201 to indicate that the image forming apparatus is not in the partial coverage transparent toner mode. Incidentally, the image forming apparatus in this embodiment is also provided with a button 204 for choosing the full coverage transparent toner mode (glossy print mode).

When the image forming apparatus is not in the transparent toner mode, the controller 600, which functions as the portion for changing the image formation setting, as well as a general control portion, controls the image forming apparatus so that the image forming apparatus operates in the normal image formation mode, that is, the mode in which the transparent toner is not used, that is, only the color toners are used.

Further, when the button 204 is lit, the controller 600 controls the image forming apparatus so that the image forming apparatus forms an image in the full coverage transparent toner mode, that is, the mode in which both the color toners and transparent toner are used for image formation. When the button 201 is lit, the controller 600 controls the image forming apparatus so that the image forming apparatus operates in the partial coverage transparent toner mode, that is, the mode in which at least the transparent toner is used for image formation. That is, not only can the partial coverage transparent toner mode be used for forming an image of both the transparent toner and color toners, but also, the transparent toner alone in order to make it possible to form only a transparent image on a large number of sheets of white paper, and set the large number of sheets of white paper in the sheet feeder portion of the image forming apparatus so that a color image can be consecutively formed on each of the large number of sheets of the white paper covered with the transparent toner.

When the transparent mark mode button 201 is not lit, the gloss transparent mark button 202 and matte transparent mark button 203 are also not lit to indicates that the image forming apparatus is not in the transparent mark mode. As the transparent mark mode button 202 is pressed, both the gloss transparent mark button 202 and matte transparent mark button 203 are intermittently lit. Then, as either of the two buttons 202 and 203 is pressed, the pressed button becomes continually lit, indicating that the image forming apparatus is in the mode corresponding to the pressed button. Of the two buttons 202 and 203, the light source which was illuminating the button which was not pressed is turned off, indicating that the image forming apparatus is not in the mode corresponding to the button. The controller 600 changes the transparent toner image formation setting, based on whether the gloss transparent mark button 202 was pressed or the matte transparent mark button 203.

More concretely, in a case where an original, such as those shown in FIG. 5, is copied, the transparent mark of the original, that is, the portion of the original, which is covered only with the transparent toner is unlikely to be recognized (detected) by the image reading device (scanner). Therefore, the resultant copy of the original will not have the transparent mark. That is, if a print (copy) has a transparent mark, it means that the print (copy) is an original, whereas if a print (copy) has no transparent mark, it means that the print is a copy. Thus, a transparent mark can be used as a security enhancement image. Incidentally, a transparent mark may be in the form of any among a sign, such as a trademark, a meaningful pattern, a meaningless pattern, etc.

Figure 7:
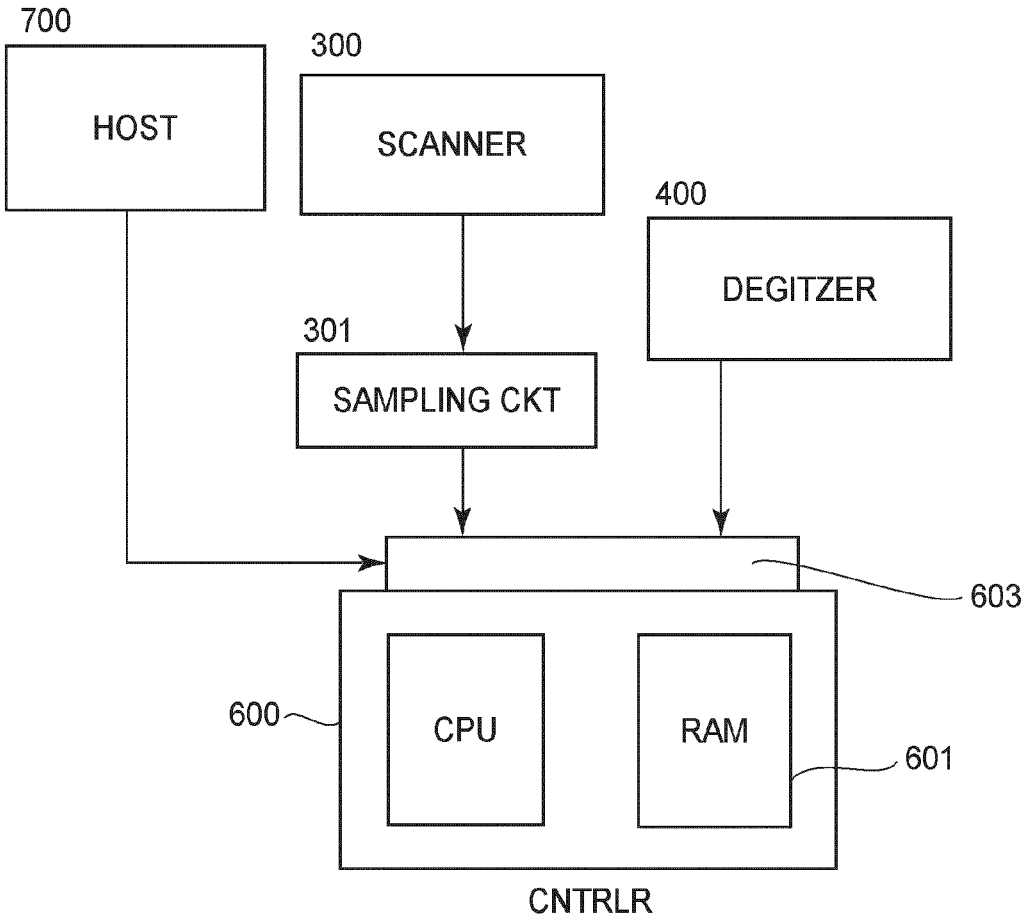
FIG. 7 is a block diagram of the digitizer and the components related to the digitizer.

First, referring to FIG. 7 which is a block diagram of a digitizer 400 and the components related thereto, a method for forming a transparent image, such as the letters and marks shown in FIG. 5(*a*) will be described (normal copy mode).

To describe the operation for indicating a specific area of an image to be formed, with the use of the digitizer 400, a user is to place an original on the digitizer 400 before starting a copying operation. Then, the user is to outline the area of concern with the use of a digitizing pen. As the area is outlined, the data regarding the coordinates of the outlined area of the original is stored in a RAM 601 shown in FIG. 7.

Next, the user is to set the original on the scanner 300 (FIG. 1), in such a manner that the original aligns with the original placement referential marker, and then, to press the copy start button of the control panel 200. As the button is pressed, the area of the original, which includes the area, the coordinates of which have been stored, is scanned. Then, the information regarding the letters in the area, the coordinates of which have been stored, is sampled by the sampling circuit 301 shown in FIG. 7. More concretely, as each of the areas having the "no copying" sign is outlined by the digitizing pen, the information regarding the "no copying" sign is sampled.

Then, the "no copying" signs are displayed on the monitor portion (visual information display) of the control panel 200. At this point, the user is to decide whether to use the partial coverage transparent toner mode to form the area of the image, which corresponds to the "no copying" sign, or not. If the user wishes to use the partial coverage transparent toner mode, the user is to press the transparent mark mode button, whereas if the user does not wishes to use the partial coverage transparent toner mode, the user is to press a reset button.

If the user chose the transparent mark mode, the user is to chose the gloss transparent mark mode or matte transparent mark mode. As described above, as an image formation start signal is inputted, the image forming apparatus operates in the mode chosen by the user.

The operation of the image forming apparatus when the image forming apparatus is in the printer mode is the same as that when the image forming apparatus is in the copy mode. That is, a user is to select the transparent toner mode icon on the printer control window, and then, to prepare an image, the portion of which the user wishes to output with the use of the transparent toner is shown in the color of one of the color toners. That is, the user is to input the information regarding the letter, mark, pattern, etc. Then, when outputting an image which includes the letter, mark, paten, etc., the information of which has been inputted, the user is to set the image formation mode as described above. That is, the user chose the partial coverage transparent toner mode, the user is to select either the gloss transparent mark mode or matte transparent mark mode. Lastly, as the user presses the print output button, the abovementioned electrical information is transmitted to the image forming apparatus. The electrical information is inputted into the interface portion 603, which functions as the information input portion, and thereafter, is inputted into the controller 600. As the controller 600 receives the electrical information, such as the image data and the information regarding the designated area of the image, the controller 600 controls the image forming apparatus based on the received electrical information, as will be described later.

Then, a print (copy), which has the "no copying" sign is formed of the transparent toner, as a colorless security mark, which is either a matte transparent "no copying" sign, or a glossy transparent "no copying" sign, is outputted as in the copying mode.

As for another method for indicating the area of the recording medium (area of image), on which a transparent toner image is to be formed, the image forming apparatus may be designed so that the color in which a transparent image is displayed on the monitor is specified, and an image displayed in the specified color is automatically formed of the transparent toner. That is, the letter, mark, pattern, etc., displayed in the specific color on the monitor are formed of the transparent toner. In other words, the color of the displayed letter, mark, pattern, etc., is a specific color other than Y, M, C, and K, the displayed image is automatically formed of the transparent toner.

An image to formed of the transparent toner does not always need to be a security related image, such as the "no copying" sign. That is, various images may be formed of the transparent image according to the user's wishes.

As for a method, other than the above described methods, for indicating the area of the recording medium (area of image), the image forming apparatus may be designed so that the information regarding image samples, such as abovementioned letter, mark, pattern, etc., can be inputted in advance into the memory of the image forming apparatus, making it possible for a user to select an image or images from among the image samples (letter, mark, pattern, etc.), as the image to be formed of the transparent toner, on the recording medium.

(5) Adjustment Regarding Glossiness Level of Transparent Toner Image

Next, a means for adjusting the image forming apparatus in the glossiness level at which if forms a transparent toner image of only one transparent toner.

The glossiness level at which the image forming apparatus forms a toner image is changed by changing the amount by which toner is deposited on the recording medium per unit area. More concretely, in this embodiment, it is done with the use of dithering.

Incidentally, in this embodiment, the matrix for the dithering method used in the partial coverage transparent toner mode is a matrix of the area coverage modulation type, and the number of the toner levels is 16. In comparison, in the case of the full coverage transparent toner mode which requires much higher glossiness levels than the partial coverage transparent toner mode, the number of tone levels is 256. That is, the partial coverage transparent toner mode is made smaller in the number of toner levels at which a transparent toner image can be formed than the full coverage transparent toner mode, because an image formed in the full coverage transparent toner mode is desired to be substantially higher in glossiness level than an ordinary print.

To describe why a toner image changes in glossiness level, if the area of the recording medium S, which is to be covered with a toner image, is absolutely flat, and therefore, does not cause irregular reflection, the glossiness level of the area is determined by the reflectivity of the toner materials and the thickness of the toner image (toner layer). That is, it is reasonable to think that the glossiness level of a print is between the glossiness level of the recording medium, which is determined by the reflectivity of the surface of the recording medium, and the glossiness level of the surface of the toner image (toner materials) which is substantial in thickness. That is, the glossiness level at which a toner image is formed simply increases or decreases according to the reflectivity of the surface of the recording medium and the reflectivity of the surface of the toner image formed on the recording medium.

However, if the dithering is used, a resultant image is made up of numerous pixels, which are covered or not covered with toner depending on the pattern of the matrix for the dithering. Thus, if the dithering is used, a resultant image is not flat, and therefore, irregularly reflects light, being therefore less glossy than an image formed without using the dithering.

The flatness of the surface of an image is affected by the physical properties, such as meltability, of the toner material, structure of the fixing apparatus, fixation setting, recording medium type, etc., because there are situations when toner particles which are roughly 5-10 μm in diameter remain intact in shape, and therefore, leave the image surface irregular, and also, there are situations when they completely melt, and therefore, make the image surface flat. That is, as the toner particles remain intact in shape (spherical), the image surface remains irregular as if it were covered with numerous microscopic spherical objects, even after the fixation. Thus, the image surface causes irregular reflection, reducing in glossiness level.

Thus, the level at which the area of an image, which is to be formed of the transparent toner, or to be covered with the transparent toner, results in glossiness, can be changed by changing the image formation setting for forming the transparent toner image. As the means for changing the glossiness level at which the abovementioned area(s) is formed, the image exposure control may be changed, and also, the bias applied to the charging device and/or the bias applied to the developing device, may be charged.

Therefore, even if the number of transparent toners usable for a given image forming operation is only one, the glossiness level at which a given area of the print will be formed of transparent toner and/or covered with transparent toner, can be varied by changing the transparent image formation setting. That is, any means is acceptable, as long as the means can change the amount by which toner is deposited on recording medium per unit area of the recording medium.

Figure 8:
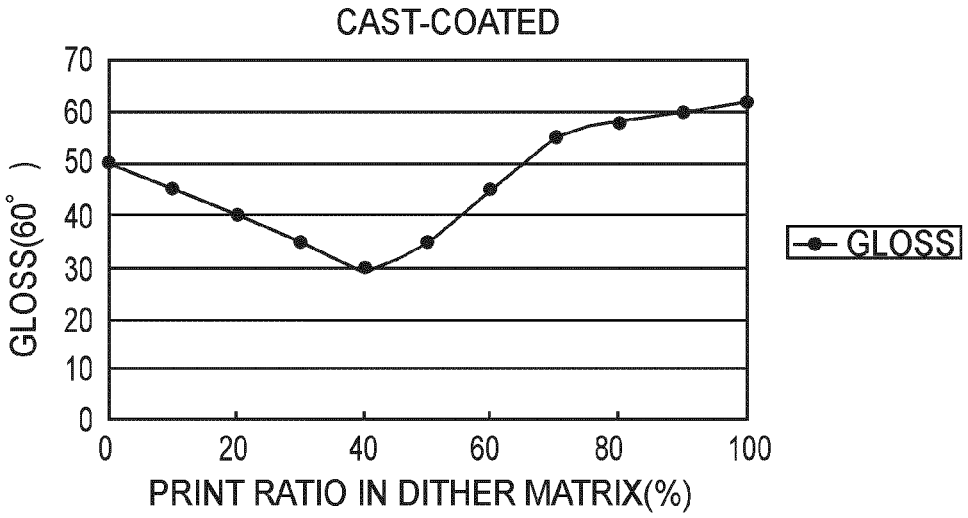
FIG. 8 is a graph showing the relationship between the glossiness level and the printing ratio of the dither matrix.

In this embodiment, the printing pattern of the dither matrix is changed by changing the number of the numerous points exposed by the beam of laser light projected from the exposing apparatus A (latent image writing means). FIG. 8 is a graph showing the relationship between the print ratio (100% if all pixels were exposed, and 0% if no pixel was exposed) of the dither matrix and the glossiness level. The recording medium was a cast coat paper (product NS701 of Canon), that is, a high gloss paper, which is 150 g/m$^2$ in basis weight. The vertical axis represents the glossiness level measured by a 60° glossmeter, and horizontal axis represents the print ratio (%) of the dither matrix.

It is evident from the graph that the glossiness level was lowest at roughly 3 when the amount of image data was roughly 40% (six dot printing), and also, that when the amount of image data was close to zero, the glossiness of a print was attributable primarily to the glossiness of the cast coat paper, and the amount by which the toner contributed to the glossiness of a print gradually increased roughly in proportion to the amount by which toner was deposited on the recording medium. Further, where the print ratio of the dither matrix was no less than 60%, the glossiness level was roughly at the same value, because where the print ratio was no less than 60%, the adjacent toner dots were likely to become joined with each other.

Figure 10:
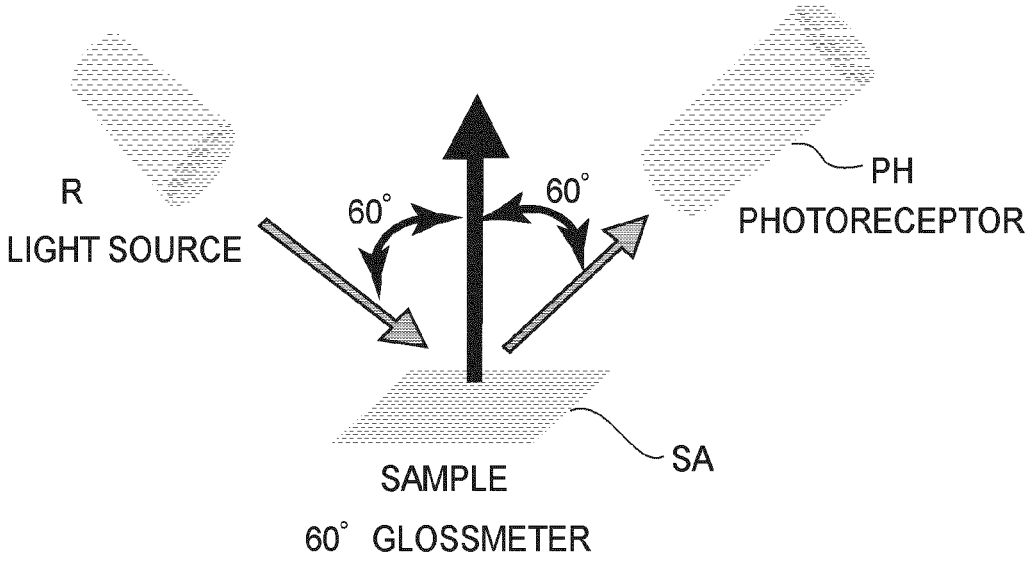
FIG. 10 is a schematic drawing for describing the principle on which a glossmeter is based.

To describe again why an image formed of dots (dither matrix) is lower in glossiness level than an image formed with the use of an analog method, referring to FIG. 10, the principle on which a glossmeter is based is to determine the reflectivity of the surface of a sample SA by measuring the intensity level of the flux of light projected from a light source R is received by the light receiving device PH after being reflected (deflected) by the surface of the sample SA in the opposite direction from the direction from which the flux of light projected, at the same angle as the angle of incidence relative to the surface of the sample SA.

Figure 11:
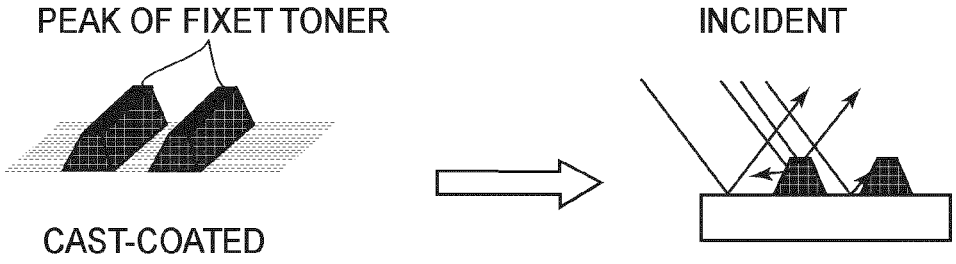
FIG. 11 is a schematic drawing for describing the phenomenon that the glossiness level of a given area of recording medium is affected by the amount of the toner on the area.

FIG. 11 is a schematic perspective drawing of the lines made up of the multiple dots formed of toner. The dark ridges in the drawing represent the lines in a fixed image formed at a given density level. In a case where toner is deposited in the shape of a ridge, such as those shown in FIG. 11, as a flux of light is projected upon the surface of the image, it is irregularly reflected by the lateral surface of the ridge, reducing the portion of the flux of light, which reaches the light receiving portion PH (photosensor).

In a highlight area of an image, the ridges are wider, that is, the ridges are greater in size, and therefore, is higher in image density. Further, in a solid area of an image, the ridges are even wider, having become joined with the adjacent ridges. In this case, however, the ridges are lower, and therefore, the recesses among the ridges are shallower. Therefore, the amount by which the abovementioned flux of light is irregularly reflected by the image surface is smaller. Therefore, the solid area of an image is higher in glossiness level.

It is reasonable to think that the glossiness level at which the image forming apparatus outputs a given area of an image is affected by the data based on which a toner image is formed, that is, the amount by which toner is deposited on recording medium, through the above described mechanism. This mechanism was described above with reference to the case in which the lines in an image were made up of multiple dots formed of toner. However, the glossiness level is similarly affected by dot growth and/or errors in dot distribution.

Referring again to FIG. 8, when the relationship between the glossiness level and the print radio of the dither matrix is as shown in FIG. 8, the glossiness level varies within a range of 30-60.

The controller 600, which also functions as the portion for adjusting the image formation setting, changes the transparent toner formation setting in response to the glossiness level value (whether high gloss transparent mark button 202 or matte transparent mark button 203 is pressed).

Figure 13:
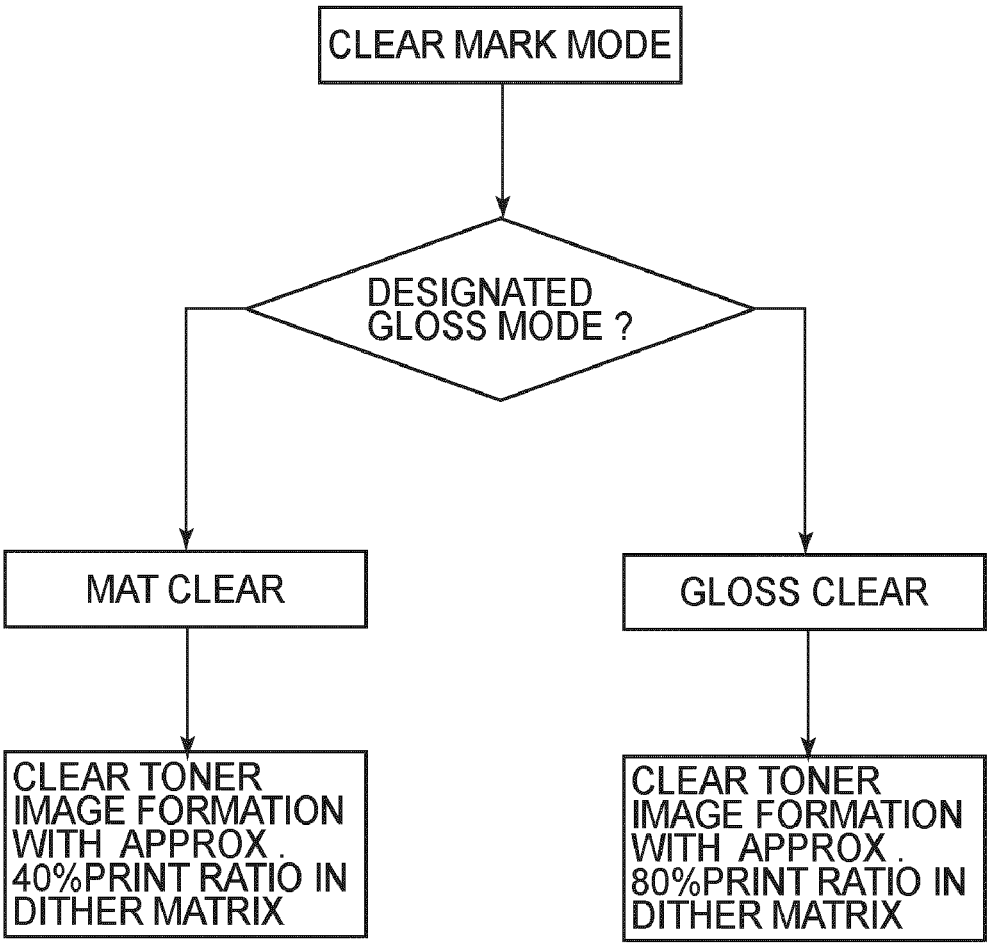
FIG. 13 is a flowchart of the operation for changing the image formation setting, in the first embodiment.

Referring to FIG. 13, in this embodiment, if the matte transparent mark mode is chosen while the image forming apparatus is in the transparent toner mode, the controller 600 sets the print ratio for the dither matrix to roughly 40% to form a transparent toner image. On the other hand, if the gloss transparent mark mode is chosen, the controller 600 set the print ratio for the dither matrix to roughly 80% to form a transparent toner image.

With the use of the abovementioned control, a glossiness level difference of no less than 10 can be achieved between the area of recording medium, which is covered with the transparent toner (transparent toner image) and the plain area of recording medium. That is, not only is it possible to make a viewer recognize the presence of a transparent mark against the plain area of recording medium, which serves as the background of the transparent toner image, but also, to adjust the image forming apparatus to achieve a desired degree of conspicuousness for the transparent mark.

As described above, according to this embodiment, even an image forming apparatus designed so the number of transparent toners it uses is only one can be varied in the glossiness level at which it forms a given area of an image with the use of the transparent toner. It should be noted here that whether in the gloss transparent mark mode or in the matte transparent mark mode, the amount, per unit area, by which the transparent toner is deposited on recording medium to form a transparent toner image is practically the same regardless of the location of a given point of the recording medium, to which the transparent toner is deposited for the formation of the transparent toner mark. For example, the entirety of the area of the recording medium, which is covered with the transparent toner, are practically the same in the amount, per unit area, by which the transparent toner is deposited on recording medium to form the "no copying" sign, that is, a transparent mark, on the recording medium.

Further, referring to FIG. 10, which shows another example of the glossiness level of the transparent toner image formed on a piece of low gloss paper, more specifically, POD matte-coat paper (product of Oji Paper Co., Limited), which is 158 g/cm$^2$ in basis weight.

In the case of this matte-coated paper, its surface, which corresponds to the background (blank) area of an image, is low in glossiness level. Therefore, increasing the print ratio of the dither matrix does not reduce the glossiness level. In the matte transparent mark mode, the smaller the amount by which toner is deposited on recording medium per unit area, the better. However, if the print ratio of the dither matrix is excessively low, it is sometimes impossible for a viewer to recognize the presence of a transparent mark. Thus, in the gloss transparent mark mode, it is desired that the print ratio of the dither matrix is set to roughly 40%. On the other hand, in the gloss transparent mark mode, the greater the amount by which the transparent toner is deposited on recording medium per unit area, the more desirable. However, increasing the amount by which the transparent toner is deposited on recording medium per unit area increases the amount of transparent toner usage, which results in cost increase. Thus, in the gloss transparent mark mode, it is desired that the print ratio of the dither matrix is set to roughly 80%.

Figure 9:
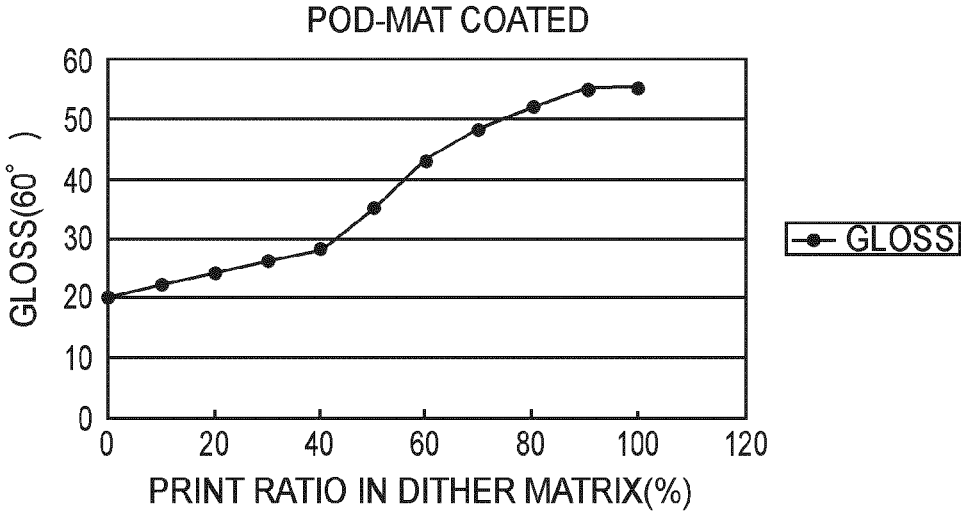
FIG. 9 is a graph showing the relationship between the glossiness level of an image formed on a sheet of POD matte coat paper, of transparent toner, and the amount of the toner deposited on the recording medium.

As described above, according to this embodiment, it is possible to vary the glossiness level at which the image forming apparatus forms a transparent toner image, regardless of the glossiness level of recording medium. Further, in this embodiment, the print ratio of the dither matrix, which is used in the gloss transparent mark mode, and the print ratio of the dither matrix, which is used in the matte transparent mark mode, are kept the same regardless of the recording medium type. More concretely, in the gloss transparent mark mode, the print ratio is set to roughly 80%, whereas in the matte transparent mark mode, it is set to roughly 40%. Even through the print ratio for the gloss transparent mark mode and the print ratio for the matte transparent mark mode are kept the same regardless of the recording medium type, the image forming apparatus can be controlled so that it forms an image, the transparent mark of which is conspicuous, as well as an image, the transparent mark of which is inconspicuous, based on the relationship between the glossiness level and the print ratio of the dither matrix, which are shown in FIGS. 8 and 9.

Figure 12:
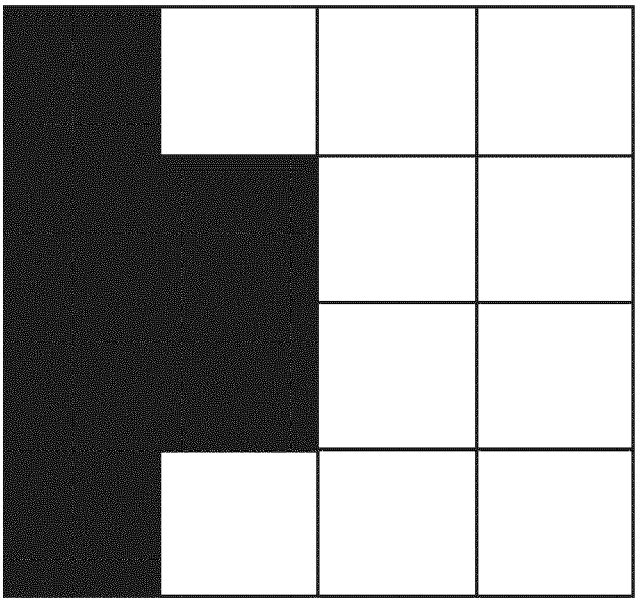
FIG. 12 is an example of a print pattern of the dither matrix.

If the dither matrix is such that the area of toner deposition is concentrated on one side as shown in FIG. 12, the surface of a resultant image is more likely to irregularly reflect a flux of light. Further, since the print ratio of the dither matrix in this embodiment is roughly 40%, the six cells of the dither matrix are to be covered with the transparent toner. On the other hand, in the case of the dither matrix which is 80% in print ratio, the cells of the dither matrix, which corresponds to the area of recording medium, which is to be covered with the transparent toner, are scattered.

The printing pattern of this dither matrix can be stored in advance in the controller 600 of the image forming apparatus. It may be inputted in advance as a default pattern in the controller 600, or may be inputted by a user.

As described above, the image forming apparatus in this embodiment can accommodate the user's wishes, whether the user wishes to form an image, the transparent mark of which is inconspicuous, or an image, the transparent mark of which is conspicuous.

Embodiment 2

In this embodiment, when the image forming apparatus is in the partial coverage transparent toner mode, the transparent toner image formation setting of the image forming apparatus can be changed according to the type of the recording medium used for image formation. The image forming apparatus in this embodiment is roughly the same in structure as that in the first embodiment, except for the portion related to the features which will be described next. Thus, the structural components of the image forming apparatus in this embodiment, which are the same in structure to the counterparts in the first embodiment, will be given the same referential symbols as those given to the counterparts, and will not be described in detail.

Also in this embodiment, the image forming apparatus is provided with a transparent mark formation mode button 201, a gloss transparent mark button 202, and a matte transparent mark button 203, such as those with which the image forming apparatus in the first embodiment are provided one for one, as shown in FIG. 4. The buttons 202 and 203 are subordinate to the button 201. The controller 600 also functions as the means for changing the image formation setting of the image forming apparatus. As the transparent mark formation mode 201 is pressed, that is, as the partial coverage transparent toner mode, which is one of the image formation modes in which the transparent toner is used, is selected, the controller 600 controls the image forming apparatus as follows. That is, it changes the amount by which the transparent toner will be deposited on recording medium per unit area, based on the information regarding which of the gloss transparent mark mode and matte transparent mark mode was selected with the use of the gloss transparent mark button 202 and the matte transparent mark button 203, respectively, and the information regarding the recording medium type.

The control panel of the apparatus main assembly 100 is provided with two cassette selection buttons for choosing cassettes C1 and C2, in which multiple sheets of recording medium of one type, and multiple sheets of recording medium of another type, are stored, respectively. A user can choose the type of recording medium, which the user wishes to use for image formation, with the use of these cassette selection buttons. Further, the image forming apparatus is designed so that the information regarding the types of recording medium set in the cassettes C1 and C2 is to be inputted in advance by the user into the apparatus main assembly 100 (memory of controller 600) through the control panel.

The control panel is also provided with a pair of buttons for choosing between "matte paper" and "gloss paper." The chosen paper is displayed on the monitor portion of the control panel. Further, the image forming apparatus in this embodiment is designed so that the user can set the glossiness level at which a transparent toner image will be formed of the transparent toner, by pressing the gloss transparent mark button 202 or matte transparent mark button 203, as the user can in the first embodiment.

Figure 14:
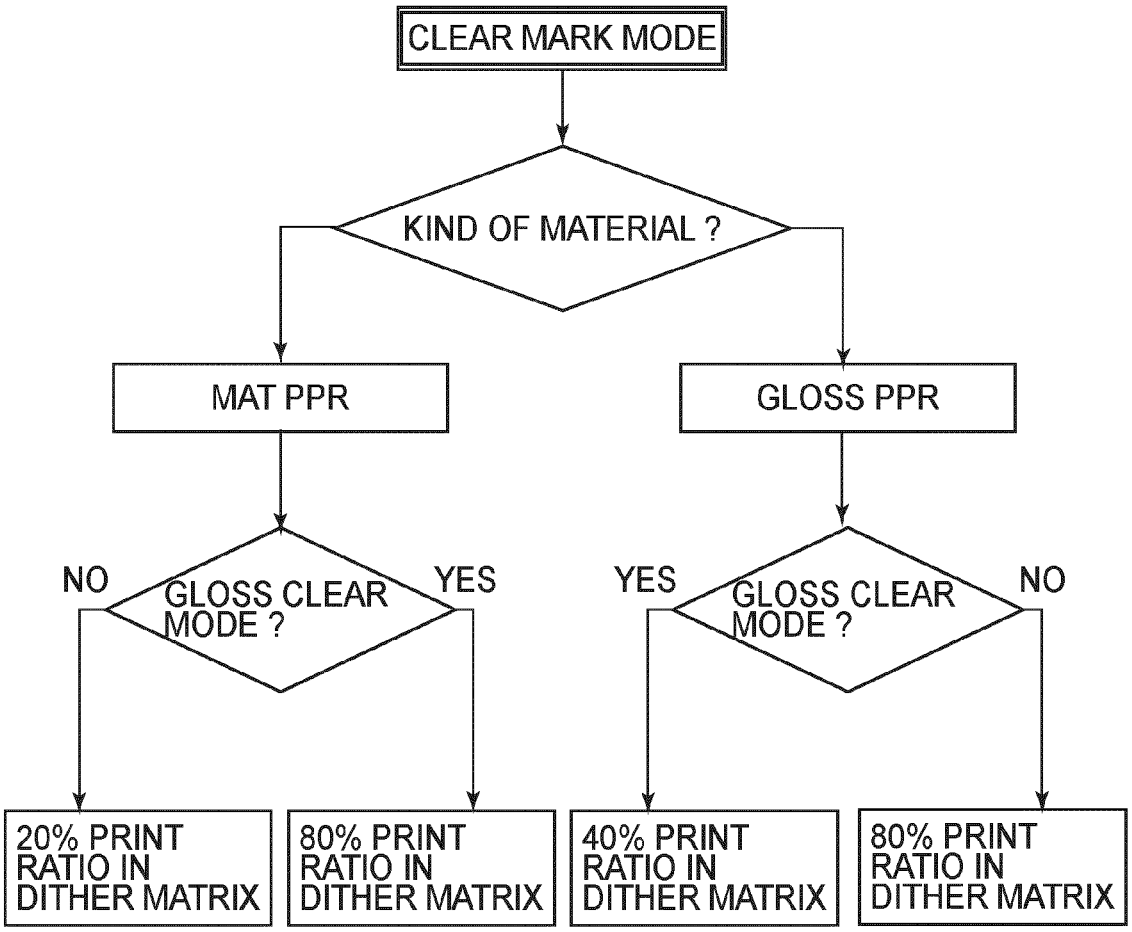
FIG. 14 is a flowchart of the operation for changing the image formation setting, in the second embodiment.

FIG. 14 is a flowchart of the control sequence to be carried out by the controller 600. If the transparent mark mode, which is one of the partial coverage transparent toner modes, is chosen, the matte paper is chosen as the recording medium to be used for image formation, and also, the gloss transparent mark mode is chosen, the controller 600 sets the print ratio for the dither matrix to roughly 80%. On the other hand, if the matte transparent mark mode is chosen instead of the gloss transparent mark mode, the controller 600 sets the print ratio for the dither matrix to roughly 20%.

Further, if the transparent mark formation mode is chosen, the gloss paper is chosen as the recording medium to be used for image formation, and also, the gloss transparent mark mode is chosen, the controller 600 sets the print ratio for the dither matrix to roughly 40%, whereas if the matte transparent mark mode is chosen in place of the gloss transparent mark mode, the controller 600 sets the print ratio for the dither matrix to roughly 80%.

Designing an image forming apparatus as described above makes it possible for the transparent toner image formation setting of the image forming apparatus to be properly adjusted according to the glossiness level of the recording medium surface which makes up the background (blank) portion the image, which is chosen based on whether a user wishes to form a conspicuous transparent toner image or an inconspicuous transparent toner image.

In this embodiment, the selection of the recording medium type is made between the matte paper and gloss paper. However, this embodiment is not intended to limit the present invention in the method for selecting recording medium type. For example, an image forming apparatus may be designed so that the amount (print ratio) by which the transparent toner is deposited on recording medium per unit area can be set according to the brand name of the recording medium used for image formation. In such a case, an image forming apparatus may be designed so that the brand names of widely used recording media can be inputted by a user into the controller 600, and also, so that the glossiness level tables for those media can be stored in the memory.

More specifically, a glossiness level table designed so that if a recording medium which is high in glossiness level is used in the matte transparent mark mode, the print ratio is set to 40%, whereas if a recording medium which is high in glossiness level is used in the gloss transparent mark mode, the printing ratio is set to 80%, and also, so that if a recording medium which is low in glossiness level is used in the matte transparent mark mode, the print ratio is set to roughly 20%, whereas if a recording medium which is low in glossiness level is used in the gloss transparent mark mode, the printing ratio is set to roughly 80%, is stored in advance in memory.

This embodiment is intended to deal with the phenomenon that the conspicuousness of a transparent toner image is affected by the glossiness level of the surface of the recording medium, that is, the glossiness level of the blank areas (background area) of the transparent toner image. That is, in the case of a recording medium which is high in glossiness level, the higher a transparent toner image in glossiness level, the less conspicuous the transparent toner image, whereas the lower a transparent toner image in glossiness level, the more conspicuous the transparent toner image. That is, the greater the difference in glossiness level between a recording medium and the transparent toner image thereon, the more conspicuous the transparent toner image; the smaller the difference in glossiness level between a recording medium and the transparent toner image thereon, the less conspicuous the transparent toner image. Further, in this embodiment, the print pattern for the dither matrix is also changed according to the recording medium type, and the transparent toner image formation mode.

As described above, according to this embodiment, it is possible to provide an image forming apparatus which allows a user to set the glossiness level at which a transparent toner image is formed, to a value desired by the user.

Embodiment 3

In the second embodiment, the amount by which the transparent toner is deposited on recording medium per unit area in the transparent mark mode, is set according to the type of the recording medium chosen by a user. In this embodiment, in order to automate the process of setting the glossiness level at which a transparent mark (toner image) is formed, the image forming apparatus is provided with a glossiness level sensor, which is used as a detecting means for detecting the glossiness level of recording medium. That is, the image forming apparatus in this embodiment is substantially different from those in the preceding embodiments only in that it is automated in the process of selecting the glossiness level at which it forms a transparent toner image (mark). That is, the image forming apparatus in this embodiment is the same in structure as those in the preceding embodiments, except for the portion related to the automation of the glossiness level selecting process. Thus, the structural components of the image forming apparatus in this embodiment, which are the same in structure to the counterparts in the preceding embodiments, will be given the same referential symbols as those given to the counterparts, and will not be described in detail.

The image forming apparatus in this embodiment is characterized in that it is provided with a glossiness level detecting means for detecting the glossiness level of the recording medium as the recording medium is conveyed through the apparatus main assembly 100, and changes the transparent toner image formation setting according to the information regarding the detected glossiness level of the recording medium. Thus, the image forming apparatus in this embodiment is capable of setting the glossiness level at which a transparent toner image will be formed on the recording medium, to a level which is proper relative to the glossiness level of the surface of the recording medium, without requiring a user to go through the troublesome process of changing the transparent toner image formation setting.

Also in this embodiment, the image forming apparatus is provided with a transparent mark formation mode button 201, a gloss transparent mark button 202, and a matte transparent mark button 203, such as those with which the image forming apparatus in the first embodiment are provided one for one, as shown in FIG. 4. The buttons 202 and 203 are subordinate to the button 201. The controller 600 also functions as the means for changing the image formation setting of the image forming apparatus. As the transparent mark formation mode 201 is pressed, that is, as the partial coverage transparent toner mode, which is one of the image formation modes in which the transparent toner is used, is selected, the controller 600 controls the image forming apparatus as follows. That is, it changes the amount by which the transparent toner will be deposited on recording medium per unit area, based on the information regarding which of the gloss transparent mark mode and matte transparent mark mode was selected with the use of the gloss transparent mark button 202 and the matte transparent mark button 203, respectively, and the information regarding the glossiness level of the recording medium, which is detected by the glossiness level detecting means.

Figure 16:
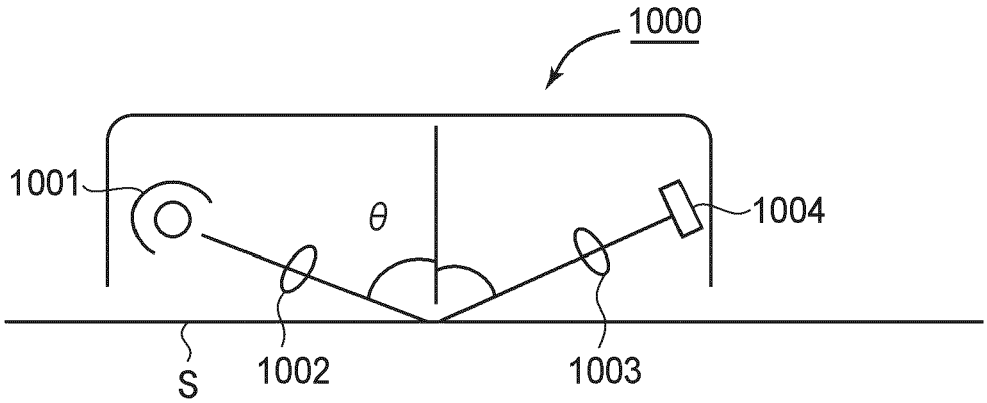
FIG. 16 is a schematic drawing of a glossiness level sensor (glossmeter) in the third embodiment of the present invention.

Shown in FIG. 16 is the general structure of the glossiness level sensor 1000, which measures the glossiness level of an object using the method defined in JISZ 8741. That is, a flux of light is projected upon a surface, the glossiness level of which is to be measured, at the angle defined in JISZ 8741, and the amount of the light reflected (deflected) by the surface at the angle defined in JISZ 8741, in the opposite direction from which the flux of light is projected upon the surface, is measured by the glossiness level sensor 1000. This glossiness level sensor measures the glossiness level of the recording medium S while the recording medium S is conveyed to the transfer belt 7 after being fed into the apparatus main assembly 100 from the manual sheet feeder tray or sheet feeder cassette.

Referring to FIG. 16, the flux of light projected from a light source 1001 transmits through a lens 1002, and projects upon the recording medium S at an angle of θ, being reflected (deflected) by the surface of the recording medium S, in the opposite direction from the direction from which the flux of light is projected. Then, the reflected portion of the flux of light transmits through a lens 1003, and reaches the light receiving device 1004, being measured by the device 1004. Since the image forming apparatus in this embodiment is provided with the above described glossiness level sensor 1000, it can detect the surface glossiness of the recording medium as the recording medium is conveyed through the apparatus. Incidentally, the glossiness level of the surface of the recording medium is measured with the angle of incidence set at 60°.

The controller 600 automatically changes the transparent toner image formation setting, based on the glossiness level of the recording medium detected by the glossiness level sensor 1000, in the transparent mark mode.

That is, if a user wishes to form an image, the transparent portion of which is conspicuous, the image forming apparatus automatically sets the amount by which the transparent toner is deposited on the recording medium per unit area, so that an image which is greater in the difference in glossiness level between the plain surface of the recording medium, and the portion of the recording medium, which is covered with the transparent toner.

The glossiness level at which an image is formed of the transparent toner is affected by the properties of the recording medium, environment in which an image forming apparatus is operated, and the setting of the fixing apparatus. Therefore, it is desired that a user inputs a numerical value desired by the user, for the glossiness level at which a transparent toner image is to be formed.

Figure 15:
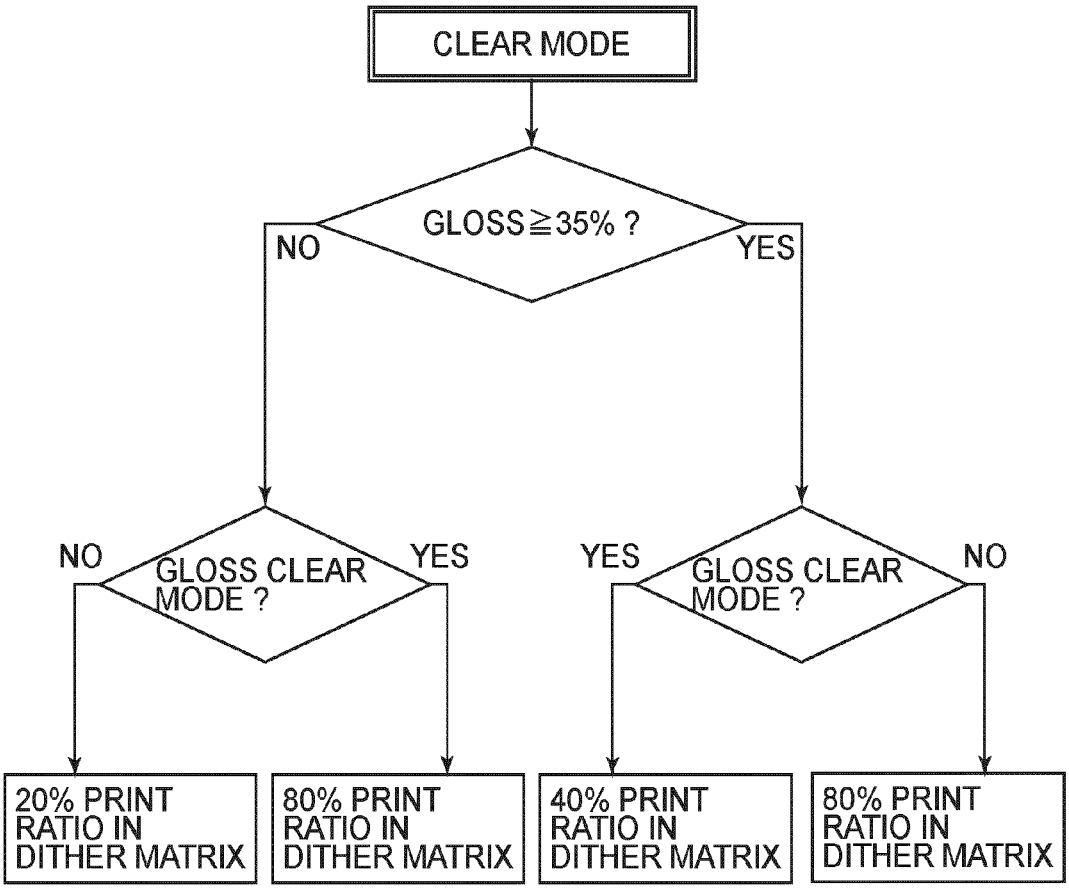
FIG. 15 is a flowchart of the operation for changing the image formation setting, in the third embodiment.

FIG. 15 is a flowchart of the control sequence to be carried out by the controller 600.

As the transparent mark formation mode is selected, first, the glossiness level of the recording medium is detected. If the detected glossiness level of the recording medium is no less than 35, it is determined that the recording medium is a high gloss paper, whereas if it is no more than 35, it is determined that the recording medium is a low gloss paper.

If it is determined that the recording medium is a high gloss paper when the image forming apparatus is in the gloss transparent mark mode, the controller 600 sets the printing ratio for the dither matrix to roughly 40%, in order to form an image, the transparent mark of which is conspicuous. On the other hand, if it is determined that the recording medium is a high gloss paper when the image forming apparatus is in the matte transparent mark mode, the controller 600 sets the printing ratio for the dither matrix to roughly 80%, in order to form an image, the transparent mark of which is inconspicuous.

Further, if it is determined that the recording medium is a low gloss paper (no higher than 35% in glossiness level) when the image forming apparatus is in the gloss transparent mark mode, the controller 600 sets the printing ratio for the dither matrix to roughly 20%, in order to form an image, the transparent mark of which is conspicuous. On the other hand, if it is determined that the recording medium is a low gloss paper when the image forming apparatus is in the matte transparent mark mode, the controller 600 sets the printing ratio for the dither matrix to roughly 80%, in order to form an image, the transparent mark of which is inconspicuous.

As described above, the employment of the image forming apparatus structure in this embodiment makes it possible to provide an image forming apparatus which allows a user to choose a glossiness level, which matches the user's intention, for the transparent toner covered area of an image.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 202745/2007 filed Aug. 3, 2007 which is hereby incorporated by reference.

What is claimed is:

1. An image forming system comprising:

an image forming station for forming a transparent image on a recording material with transparent toner;

obtaining means for obtaining a transparent image for specifying an area for forming, on a part of the recording material, a mark which is visible by a difference in glossiness;

a selecting portion for selecting one of image forming modes including a first image forming mode in which a glossiness of the transparent image obtained by said obtaining means is relatively high, and a second image forming mode in which a glossiness of the transparent image obtained by said obtaining means is relatively low; and control means for controlling an amount of the transparent toner, per unit area, of the transparent image formed on the recording material in accordance with the image forming mode selected by said selecting portion, wherein said control means controls the amount of the toner per unit area for the transparent image formed on the recording material in accordance with a kind of the recording material and the image forming mode selected by said selecting portion.

2. An image forming system comprising:

an image forming station for forming a transparent image on a recording material with transparent toner;

obtaining means for obtaining a transparent image for specifying an area for forming, on a part of the recording material, a mark which is visible by a difference in glossiness;

a selecting portion for selecting one of image forming modes including a first image forming mode in which a glossiness of the transparent image obtained by said obtaining means is relatively high, and a second image forming mode in which a glossiness of the transparent image obtained by said obtaining means is relatively low;

control means for controlling an amount of the transparent toner, per unit area, of the transparent image formed on the recording material in accordance with the image forming mode selected by said selecting portion; and a detecting portion for detecting a glossiness of the recording material, wherein said control means controls the amount of the toner per unit area for the transparent image formed on the recording material in accordance with an output of said detecting portion and the image forming mode selected by said selecting portion.

3. A system according to claim 2, wherein when the detected glossiness of the recording material is not less than a predetermined value, said control means controls a larger amount of the toner per unit area for the transparent image formed on the recording material in the first image forming mode than that in the second image forming mode, and wherein when the detected glossiness of the recording material is less than the predetermined value, said control means controls a larger amount of the toner per unit area for the transparent image formed on the recording material in the first image forming mode than that in the second image forming mode.

4. An image forming system comprising:

a transparent image forming station for forming a transparent image on a recording material with transparent toner;

obtaining means for obtaining a transparent image for specifying an area for forming, on a part of the recording material, a mark which is visible by a difference in glossiness;

an input portion for inputting information for executing an image forming mode selected from image forming modes including a first image forming mode in which a glossiness of the transparent image obtained by said obtaining means is relatively high, and a second image forming mode in which a glossiness of the transparent image obtained by said obtaining means is relatively low; and control means for controlling an amount of the transparent toner, per unit area, of the transparent image formed on the recording material in accordance with the image forming mode inputted by said input portion, wherein said control means controls the amount of toner per unit area for the transparent image formed on the recording material in accordance with a kind of the recording material and the image forming mode inputted by said input portion.

5. An image forming system comprising:

a transparent image forming station for forming a transparent image on a recording material with transparent toner;

obtaining means for obtaining a transparent image for specifying an area for forming, on a part of the recording material, a mark which is visible by a difference in glossiness;

an input portion for inputting information for executing an image forming mode selected from image forming modes including a first image forming mode in which a glossiness of the transparent image obtained by said obtaining means is relatively high, and a second image forming mode in which a glossiness of the transparent image obtained by said obtaining means is relatively low;

control means for controlling an amount of the transparent toner, per unit area, of the transparent image formed on the recording material in accordance with the image forming mode inputted by said input portion; and a detecting portion for detecting a glossiness of the recording material, wherein said control means controls the amount of toner per unit area for the transparent image formed on the recording material in accordance with an output of said detecting portion and the image forming mode, inputted by said input portion.

6. A system according to claim 5, wherein when the detected glossiness of the recording material is not less than a predetermined value, said control means controls a larger amount of the toner per unit area for the transparent image formed on the recording material in the first image forming mode than that in the second image forming mode, and wherein when the detected glossiness of the recording material is less than the predetermined value, said control means controls a larger amount of the toner per unit area for the transparent image formed on the recording material in the first image forming mode than that in the second image forming mode.

* * * * *